US009670425B2

(12) United States Patent
Vanden Bussche et al.

(10) Patent No.: US 9,670,425 B2
(45) Date of Patent: Jun. 6, 2017

(54) PROCESS FOR OLIGOMERIZING AND CRACKING TO MAKE PROPYLENE AND AROMATICS

(71) Applicant: UOP LLC, Des Plaines, IL (US)

(72) Inventors: Kurt M. Vanden Bussche, Lake in the Hills, IL (US); Christopher P. Nicholas, Evanston, IL (US); Todd M. Kruse, Oak Park, IL (US)

(73) Assignee: UOP LLC, Des Plaines, IL (US)

( * ) Notice: Subject to any disclaimer, the term of this patent is extended or adjusted under 35 U.S.C. 154(b) by 489 days.

(21) Appl. No.: 14/108,585

(22) Filed: Dec. 17, 2013

(65) Prior Publication Data

US 2015/0166424 A1 Jun. 18, 2015

(51) Int. Cl.

| | |
|---|---|
| ***C07C 2/08*** | (2006.01) |
| ***C10G 57/02*** | (2006.01) |
| ***C10G 50/00*** | (2006.01) |
| ***C10G 11/18*** | (2006.01) |

(52) U.S. Cl.

CPC ..... *C10G 57/02* (2013.01); *C10G 11/18* (2013.01); *C10G 50/00* (2013.01); *C10G 2300/1092* (2013.01); *C10G 2400/02* (2013.01); *C10G 2400/30* (2013.01)

(58) Field of Classification Search

None

See application file for complete search history.

(56) References Cited

U.S. PATENT DOCUMENTS

| | | | | |
|---|---|---|---|---|
| 3,551,403 | A * | 12/1970 | Hoffait | B01J 19/0006 526/59 |
| 4,268,701 | A | 5/1981 | Dang Vu et al. | |
| 4,433,185 | A | 2/1984 | Tabak | |
| 4,456,781 | A | 6/1984 | Marsh et al. | |
| 4,520,215 | A | 5/1985 | Owen et al. | |
| 4,568,786 | A | 2/1986 | Hsia Chen et al. | |
| 4,665,245 | A | 5/1987 | Quann | |
| 4,822,477 | A | 4/1989 | Avidan et al. | |
| 4,926,003 | A | 5/1990 | Harandi et al. | |
| 4,956,514 | A | 9/1990 | Chu | |
| 5,000,840 | A | 3/1991 | Anthes et al. | |

(Continued)

FOREIGN PATENT DOCUMENTS

| | | |
|---|---|---|
| EP | 0392590 A1 | 10/1990 |
| EP | 0800568 B1 | 10/1997 |

(Continued)

OTHER PUBLICATIONS

Search Report dated Mar. 18, 2015 for corresponding PCT Appl. No. PCT/US2014/068268.

(Continued)

*Primary Examiner* — In Suk Bullock
*Assistant Examiner* — Ali Z Fadhel

(57) ABSTRACT

A process sends at least a portion of an oligomerization feed to a first oligomerization reactor zone that includes a zeolite or a SPA catalyst and another portion of the same feed to a second oligomerization reactor zone that includes an amorphous silica alumina catalyst. The first oligomerization reactor zone makes aliphatic olefins that can be cracked to propylene and the second oligomerization reactor zone makes cyclic molecules that can be converted to aromatics in an FCC unit.

18 Claims, 5 Drawing Sheets

(56) References Cited

U.S. PATENT DOCUMENTS

| | | | | |
|---|---|---|---|---|
| 5,051,386 | A | 9/1991 | Ward et al. | |
| 5,073,351 | A | 12/1991 | Beech, Jr. et al. | |
| 5,108,970 | A | 4/1992 | Young et al. | |
| 5,243,112 | A | 9/1993 | Chester et al. | |
| 5,264,643 | A | 11/1993 | DiGuiseppi et al. | |
| 5,498,811 | A | 3/1996 | Perego et al. | |
| 5,714,661 | A | 2/1998 | Tuli et al. | |
| 5,811,608 | A | 9/1998 | Stine et al. | |
| 6,444,866 | B1 | 9/2002 | Commereuc et al. | |
| 6,686,511 | B2 | 2/2004 | Miller et al. | |
| 6,875,899 | B2 | 4/2005 | Martens et al. | |
| 7,008,527 | B2 | 3/2006 | Gauthier et al. | |
| 7,196,238 | B2 | 3/2007 | Nurminen et al. | |
| 7,262,332 | B2 | 8/2007 | Duplan et al. | |
| 7,374,662 | B2 | 5/2008 | Duplan et al. | |
| 7,425,662 | B2 | 9/2008 | Stanat et al. | |
| 7,476,773 | B2 * | 1/2009 | Louret | C10G 50/00 568/38 |
| 7,572,946 | B2 | 8/2009 | Lacombe et al. | |
| 7,579,513 | B2 | 8/2009 | Duplan et al. | |
| 7,589,244 | B2 | 9/2009 | Coupard et al. | |
| 7,611,678 | B2 | 11/2009 | Louret et al. | |
| 7,847,037 | B2 | 12/2010 | Simon | |
| 8,178,740 | B2 | 5/2012 | Nicholas et al. | |
| 8,222,470 | B2 | 7/2012 | Coupard et al. | |
| 8,461,405 | B2 | 6/2013 | Sanchez et al. | |
| 8,470,165 | B2 | 6/2013 | Cosyns et al. | |
| 8,491,781 | B2 | 7/2013 | Gauthier et al. | |
| 2004/0006250 | A1 | 1/2004 | Mathys et al. | |
| 2004/0133053 | A1 | 7/2004 | Martens et al. | |
| 2005/0049448 | A1 | 3/2005 | Loescher et al. | |
| 2005/0121361 | A1 * | 6/2005 | Duplan | C10G 11/18 208/113 |
| 2005/0182284 | A1 | 8/2005 | Stanat et al. | |
| 2006/0063955 | A1 * | 3/2006 | Lacombe | C07C 2/10 585/535 |
| 2007/0049781 | A1 | 3/2007 | Brown et al. | |
| 2008/0039669 | A1 * | 2/2008 | Brown | B01J 29/06 585/514 |
| 2009/0253947 | A1 * | 10/2009 | Brandvold | C10G 50/00 585/14 |
| 2009/0292152 | A1 | 11/2009 | Brown et al. | |
| 2010/0036182 | A1 | 2/2010 | Forestiere et al. | |
| 2010/0056834 | A1 | 3/2010 | Phillion et al. | |
| 2010/0081852 | A1 | 4/2010 | Louret et al. | |
| 2010/0113847 | A1 * | 5/2010 | Kowalik | C10G 50/00 585/20 |
| 2010/0158767 | A1 | 6/2010 | Mehlberg et al. | |
| 2010/0331591 | A1 | 12/2010 | Brown et al. | |
| 2011/0084001 | A1 * | 4/2011 | Cabiac | B01J 21/12 208/135 |
| 2011/0124936 | A1 | 5/2011 | Cabiac et al. | |
| 2011/0172482 | A1 | 7/2011 | Cabiac et al. | |
| 2011/0230690 | A1 | 9/2011 | Tiita et al. | |
| 2011/0282120 | A1 | 11/2011 | Buchanan et al. | |
| 2012/0029255 | A1 | 2/2012 | Digne et al. | |
| 2012/0116141 | A1 | 5/2012 | Godsmark et al. | |
| 2013/0037446 | A1 | 2/2013 | Minoux et al. | |
| 2013/0079574 | A1 | 3/2013 | Luebke et al. | |
| 2013/0180884 | A1 | 7/2013 | Minoux et al. | |
| 2013/0261359 | A1 | 10/2013 | da Silva Ferreira Alves et al. | |
| 2014/0135543 | A1 | 5/2014 | Nicholas et al. | |
| 2015/0166424 | A1 | 6/2015 | Vanden Bussche et al. | |
| 2015/0166432 | A1 | 6/2015 | Krupa et al. | |

FOREIGN PATENT DOCUMENTS

| | | | |
|---|---|---|---|
| EP | 0673352 | B1 | 4/1999 |
| WO | 2011138520 | A2 | 11/2011 |
| WO | 2013013884 | A2 | 1/2013 |

OTHER PUBLICATIONS

De Klerk, "Oligomerization of 1-Hexene and 1-Octene over Solid Acid Catalysts", Ind. Eng. Chem. Res. 2005, 44, 3887-3893.

Pater, "1-Hexene Oligomerization in Liquid, Vapor, and Supercritical Phases over Beidellite and Ultrastable Y Zeolite Catalysts", Journal of Catalysis 179, 477-482 (1998).

Quann, "Chemistry of Olefin Oligomerization over ZSM-5 Catalyst", Ind. Eng. Chem. Res. 1988, 27, 565-570.

Van Grieken, "Liquid phase oligomerization of 1-hexene over different mesoporous aluminosilicates (AI-MTS, AI-MCM-41 and AI-SBA-15) and micrometer/nanometer HZSM-5 zeolites", Applied Catalysis A: General 305 (2006) 176-188.

U.S. Appl. No. 14/108,594, filed Dec. 17, 2013.

U.S. Appl. No. 14/108,623, filed Dec. 17, 2013.

U.S. Appl. No. 14/108,636, filed Dec. 17, 2013.

U.S. Appl. No. 14/108,678, filed Dec. 17, 2013.

De Klerk, Arno et al., "Oligomerization of Fischer-Tropsch Olefins: Effect of Feed and Operating Conditions on Hydrogenated Motor-Gasoline Quality", Ind. Eng. Chem. Res., 2004, 43, 7449-7455.

Portland Fuel Price Protection: What is the difference between Gasoil (Red Diesel) and Diesel?, Posted Jan. 26, 2011.

US Environmental Protection Agency (The EPA), HPV Chemical Category Summary: Higher Olefins Category, Apr. 2005.

* cited by examiner

PROCESS FOR OLIGOMERIZING AND CRACKING TO MAKE PROPYLENE AND AROMATICS

FIELD

The field of the invention is the oligomerization of light olefins to heavier oligomers that can be converted to propylene or aromatics.

BACKGROUND

When oligomerizing light olefins within a refinery, there is frequently a desire to have the flexibility to make high octane gasoline, high cetane diesel, or combination of both. However, catalysts that make high octane gasoline typically make product that is highly branched and within the gasoline boiling point range. This product is very undesirable for diesel. In addition, catalysts that make high cetane diesel typically make product that is more linear and in the distillate boiling point range. This results in less and poorer quality gasoline due to the more linear nature of the product which has a lower octane value.

The oligomerization of butenes is often associated with a desire to make a high yield of high quality gasoline product. There is typically a limit as to what can be achieved when oligomerizing butenes. When oligomerizing butenes, dimerization is desired to obtain gasoline range material. However, trimerization and higher oligomerization can occur which can produce material heavier than gasoline such as diesel. Efforts to produce diesel by oligomerization have failed to provide high yields except through multiple passes. There is a need of some refiners to have the ability to make more aromatics in an FCC unit. Aromatics in the gasoline stream can be used within the refinery to produce very valuable xylenes. Catalysts utilized for oligomerizing light olefins to produce oligomers typically produce aliphatic gasoline or diesel range compounds which can forwarded to an FCC unit for cracking to propylene. There is a need for making more aromatics in an integrated FCC-oligomerization unit.

SUMMARY OF THE INVENTION

A first embodiment of the invention is a process for oligomerizing light olefins comprising contacting an oligomerization feed of $C_4$ olefins with a first oligomerization catalyst and a second oligomerization catalyst, the second oligomerization catalyst comprising amorphous silica alumina and is different from the first oligomerization catalyst, and recovering an oligomerate stream.

A second embodiment of the invention is a process for oligomerizing light olefins comprising providing an oligomerization feed comprising $C_4$ olefins to an oligomerization zone; feeding a first oligomerization feed comprising $C_4$ olefins to a first oligomerization reactor zone containing a first oligomerization catalyst and bypassing the first oligomerization feed around a second oligomerization reactor zone containing a second oligomerization catalyst that is different from the first oligomerization catalyst; feeding a second oligomerization feed comprising $C_4$ olefins to the second oligomerization reactor zone containing the second oligomerization catalyst comprising amorphous silica alumina and bypassing the second oligomerization feed around the first oligomerization reactor zone; and recovering an oligomerate stream. The first oligomerization catalyst may comprise SPA or a zeolite, and the second oligomerization catalyst may comprise amorphous silica alumina.

An object of the invention is to enable an oligomerization unit to make more cyclic compounds which can be converted to aromatics in an FCC unit.

DEFINITIONS

Figure 1:
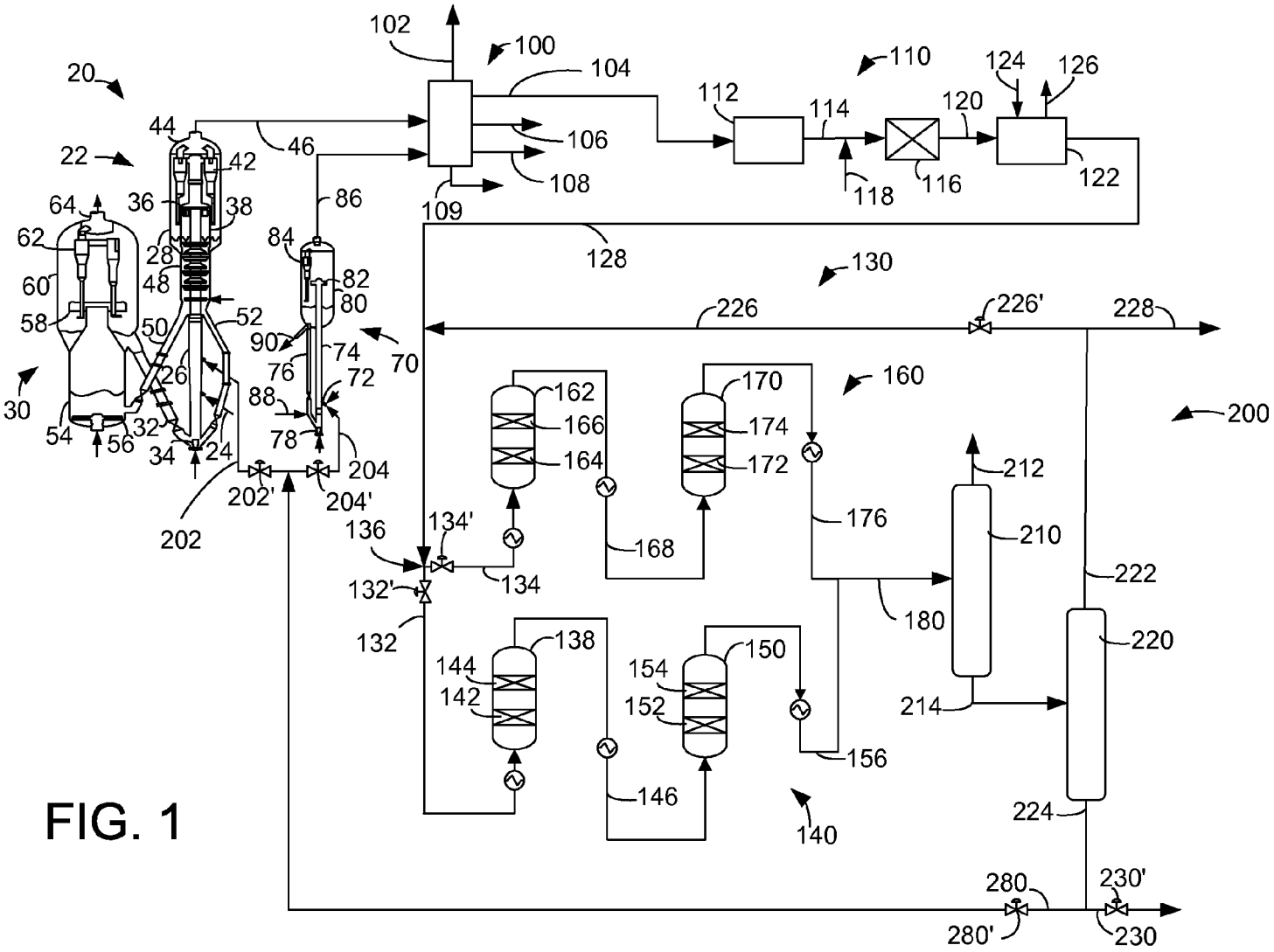
FIG. 1 is a schematic drawing of the present invention.

As used herein, the term "stream" can include various hydrocarbon molecules and other substances. Moreover, the term "stream comprising $C_x$ hydrocarbons" or "stream comprising $C_x$ olefins" can include a stream comprising hydrocarbon or olefin molecules, respectively, with "x" number of carbon atoms, suitably a stream with a majority of hydrocarbons or olefins, respectively, with "x" number of carbon atoms and preferably a stream with at least 75 wt % hydrocarbons or olefin molecules, respectively, with "x" number of carbon atoms. Moreover, the term "stream comprising $C_x$+ hydrocarbons" or "stream comprising $C_x$+ olefins" can include a stream comprising a majority of hydrocarbon or olefin molecules, respectively, with more than or equal to "x" carbon atoms and suitably less than 10 wt % and preferably less than 1 wt % hydrocarbon or olefin molecules, respectively, with x−1 carbon atoms. Lastly, the term "$C_x$−stream" can include a stream comprising a majority of hydrocarbon or olefin molecules, respectively, with less than or equal to "x" carbon atoms and suitably less than 10 wt % and preferably less than 1 wt % hydrocarbon or olefin molecules, respectively, with x+1 carbon atoms.

As used herein, the term "zone" can refer to an area including one or more equipment items and/or one or more sub-zones. Equipment items can include one or more reactors or reactor vessels, heaters, exchangers, pipes, pumps, compressors, controllers and columns. Additionally, an equipment item, such as a reactor, dryer, or vessel, can further include one or more zones or sub-zones.

As used herein, the term "substantially" can mean an amount of at least generally about 70%, preferably about 80%, and optimally about 90%, by weight, of a compound or class of compounds in a stream.

As used herein, the term "gasoline" can include hydrocarbons having a boiling point temperature in the range of about 25 to about 200° C. at atmospheric pressure.

As used herein, the term "diesel" or "distillate" can include hydrocarbons having a boiling point temperature in the range of about 150 to about 400° C. and preferably about 200 to about 400° C.

As used herein, the term "vacuum gas oil" (VGO) can include hydrocarbons having a boiling temperature in the range of from 343° to 552° C.

As used herein, the term "vapor" can mean a gas or a dispersion that may include or consist of one or more hydrocarbons.

As used herein, the term "overhead stream" can mean a stream withdrawn at or near a top of a vessel, such as a column.

As used herein, the term "bottom stream" can mean a stream withdrawn at or near a bottom of a vessel, such as a column.

As depicted, process flow lines in the figures can be referred to interchangeably as, e.g., lines, pipes, feeds, gases, products, discharges, parts, portions, or streams.

As used herein, "bypassing" with respect to a vessel or zone means that a stream does not pass through the zone or vessel bypassed although it may pass through a vessel or zone that is not designated as bypassed.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottom stream back to the bottom of the column. Feeds to the columns may be preheated. The top pressure is the pressure of the overhead vapor at the outlet of the column. The bottom temperature is the liquid bottom outlet temperature. Overhead lines and bottom lines refer to the net lines from the column downstream of the reflux or reboil to the column.

As used herein, the term "boiling point temperature" means atmospheric equivalent boiling point (AEBP) as calculated from the observed boiling temperature and the distillation pressure, as calculated using the equations furnished in ASTM D1160 appendix A7 entitled "Practice for Converting Observed Vapor Temperatures to Atmospheric Equivalent Temperatures".

As used herein, "taking a stream from" means that some or all of the original stream is taken.

DETAILED DESCRIPTION

The present invention is a process that incorporates a reactor with an amorphous silica alumina (ASA) catalyst into an oligomerization unit. ASA catalyst is typically not ideal for making propylene from the oligomerized product. An ASA catalyst produces a high content of cyclic product such as naphthenes during the oligomerization of light olefins. However, these naphthenes can be converted in an FCC unit to aromatics to a high extent. The reactor with the ASA catalyst can be run in parallel or in series with a typical oligomerization reactor employed to make heavier olefins. As is described below, in one embodiment, the first oligomerization zone contains a first oligomerization catalyst and the second oligomerization zone contains a second oligomerization catalyst comprising ASA and the feed to each oligomerization zone can be varied to achieve the quantity of propylene or aromatics desired from the FCC.

The process may be described with reference to five components shown in FIG. 1: a fluid catalytic cracking (FCC) zone 20, an FCC recovery zone 100, a purification zone 110, an oligomerization zone 130, and an oligomerization recovery zone 200. Many configurations of the present invention are possible, but specific embodiments are presented herein by way of example. All other possible embodiments for carrying out the present invention are considered within the scope of the present invention.

The FCC zone 20 may comprise a first FCC reactor 22, a regenerator vessel 30, and an optional second FCC reactor 70.

A conventional FCC feedstock and higher boiling hydrocarbon feedstock are a suitable FCC hydrocarbon feed 24 to the first FCC reactor. The most common of such conventional feedstocks is a VGO. Higher boiling hydrocarbon feedstocks to which this invention may be applied include heavy bottom from crude oil, heavy bitumen crude oil, shale oil, tar sand extract, deasphalted residue, products from coal liquefaction, atmospheric and vacuum reduced crudes and mixtures thereof. The FCC feed 24 may include an FCC recycle stream 280 to be described later.

The first FCC reactor 22 may include a first reactor riser 26 and a first reactor vessel 28. A regenerator catalyst pipe 32 delivers regenerated catalyst from the regenerator vessel 30 to the reactor riser 26. A fluidization medium such as steam from a distributor 34 urges a stream of regenerated catalyst upwardly through the first reactor riser 26. At least one feed distributor injects the first hydrocarbon feed in a first hydrocarbon feed line 24, preferably with an inert atomizing gas such as steam, across the flowing stream of catalyst particles to distribute hydrocarbon feed to the first reactor riser 26. Upon contacting the hydrocarbon feed with catalyst in the first reactor riser 26 the heavier hydrocarbon feed cracks to produce lighter gaseous cracked products and cyclics may aromatize to make aromatics while coke is deposited on the catalyst particles to produce spent catalyst.

The resulting mixture of gaseous product hydrocarbons and spent catalyst continues upwardly through the first reactor riser 26 and are received in the first reactor vessel 28 in which the spent catalyst and gaseous product are separated. Disengaging arms discharge the mixture of gas and catalyst from a top of the first reactor riser 26 through outlet ports 36 into a disengaging vessel 38 that effects partial separation of gases from the catalyst. A transport conduit carries the hydrocarbon vapors, stripping media and entrained catalyst to one or more cyclones 42 in the first reactor vessel 28 which separates spent catalyst from the hydrocarbon gaseous product stream. Gas conduits deliver separated hydrocarbon cracked gaseous streams from the cyclones 42 to a collection plenum 44 for passage of a cracked product stream to a first cracked product line 46 via an outlet nozzle and eventually into the FCC recovery zone 100 for product recovery.

Diplegs discharge catalyst from the cyclones 42 into a lower bed in the first reactor vessel 28. The catalyst with adsorbed or entrained hydrocarbons may eventually pass from the lower bed into a stripping section 48 across ports defined in a wall of the disengaging vessel 38. Catalyst separated in the disengaging vessel 38 may pass directly into the stripping section 48 via a bed. A fluidizing distributor delivers inert fluidizing gas, typically steam, to the stripping section 48. The stripping section 48 contains baffles or other equipment to promote contacting between a stripping gas and the catalyst. The stripped spent catalyst leaves the stripping section 48 of the disengaging vessel 38 of the first reactor vessel 28 stripped of hydrocarbons. A first portion of the spent catalyst, preferably stripped, leaves the disengaging vessel 38 of the first reactor vessel 28 through a spent catalyst conduit 50 and passes into the regenerator vessel 30. A second portion of the spent catalyst may be recirculated in recycle conduit 52 from the disengaging vessel 38 back to a base of the first riser 26 at a rate regulated by a slide valve to recontact the feed without undergoing regeneration.

The first riser 26 can operate at any suitable temperature, and typically operates at a temperature of about 150° to about 580° C. at the riser outlet 36. The pressure of the first riser is from about 69 to about 517 kPa (gauge) (10 to 75 psig) but typically less than about 275 kPa (gauge) (40 psig). The catalyst-to-oil ratio, based on the weight of catalyst and feed hydrocarbons entering the riser, may range up to 30:1 but is typically between about 4:1 and about 25:1. Steam may be passed into the first reactor riser 26 and first reactor vessel 28 at a rate between about 2 and about 7 wt % for maximum gasoline production and about 10 to about 30 wt % for maximum light olefin production. The average residence time of catalyst in the riser may be less than about 5 seconds.

The catalyst in the first reactor 22 can be a single catalyst or a mixture of different catalysts. Usually, the catalyst includes two catalysts, namely a first FCC catalyst, and a second FCC catalyst. Such a catalyst mixture is disclosed in, e.g., U.S. Pat. No. 7,312,370. Generally, the first FCC catalyst may include any of the well-known catalysts that are used in the art of FCC. Preferably, the first FCC catalyst includes a large pore zeolite, such as a Y-type zeolite, an active alumina material, a binder material, including either silica or alumina, and an inert filler such as kaolin.

Typically, the zeolites appropriate for the first FCC catalyst have a large average pore size, usually with openings of greater than about 0.7 nm in effective diameter defined by greater than about 10, and typically about 12, member rings. Suitable large pore zeolite components may include synthetic zeolites such as X and Y zeolites, mordenite and faujasite. A portion of the first FCC catalyst, such as the zeolite portion, can have any suitable amount of a rare earth metal or rare earth metal oxide.

The second FCC catalyst may include a medium or smaller pore zeolite catalyst, such as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second component has the medium or smaller pore zeolite dispersed on a matrix including a binder material such as silica or alumina and an inert filler material such as kaolin. These catalysts may have a crystalline zeolite content of about 10 to about 50 wt % or more, and a matrix material content of about 50 to about 90 wt %. Catalysts containing at least about 40 wt % crystalline zeolite material are typical, and those with greater crystalline zeolite content may be used. Generally, medium and smaller pore zeolites are characterized by having an effective pore opening diameter of less than or equal to about 0.7 nm and rings of about 10 or fewer members. Preferably, the second FCC catalyst component is an MFI zeolite having a silicon-to-aluminum ratio greater than about 15. In one exemplary embodiment, the silicon-to-aluminum ratio can be about 15 to about 35.

The total catalyst mixture in the first reactor 10 may contain about 1 to about 25 wt % of the second FCC catalyst, including a medium to small pore crystalline zeolite, with greater than or equal to about 7 wt % of the second FCC catalyst being preferred. When the second FCC catalyst contains about 40 wt % crystalline zeolite with the balance being a binder material, an inert filler, such as kaolin, and optionally an active alumina component, the catalyst mixture may contain about 0.4 to about 10 wt % of the medium to small pore crystalline zeolite with a preferred content of at least about 2.8 wt %. The first FCC catalyst may comprise the balance of the catalyst composition. The high concentration of the medium or smaller pore zeolite as the second FCC catalyst of the catalyst mixture can improve selectivity to light olefins. In one exemplary embodiment, the second FCC catalyst can be a ZSM-5 zeolite and the catalyst mixture can include about 0.4 to about 10 wt % ZSM-5 zeolite excluding any other components, such as binder and/or filler.

The regenerator vessel 30 is in downstream communication with the first reactor vessel 28. In the regenerator vessel 30, coke is combusted from the portion of spent catalyst delivered to the regenerator vessel 30 by contact with an oxygen-containing gas such as air to regenerate the catalyst. The spent catalyst conduit 50 feeds spent catalyst to the regenerator vessel 30. The spent catalyst from the first reactor vessel 28 usually contains carbon in an amount of from 0.2 to 7 wt %, which is present in the form of coke. An oxygen-containing combustion gas, typically air, enters the lower chamber 54 of the regenerator vessel 30 through a conduit and is distributed by a distributor 56. As the combustion gas enters the lower chamber 54, it contacts spent catalyst entering from spent catalyst conduit 50 and lifts the catalyst at a superficial velocity of combustion gas in the lower chamber 54 of perhaps at least 1.1 m/s (3.5 ft/s) under fast fluidized flow conditions. In an embodiment, the lower chamber 54 may have a catalyst density of from 48 to 320 $kg/m^3$ (3 to 20 $lb/ft^3$) and a superficial gas velocity of 1.1 to 2.2 m/s (3.5 to 7 ft/s). The oxygen in the combustion gas contacts the spent catalyst and combusts carbonaceous deposits from the catalyst to at least partially regenerate the catalyst and generate flue gas.

The mixture of catalyst and combustion gas in the lower chamber 54 ascends through a frustoconical transition section to the transport, riser section of the lower chamber 54. The mixture of catalyst particles and flue gas is discharged from an upper portion of the riser section into the upper chamber 60. Substantially completely or partially regenerated catalyst may exit the top of the transport, riser section. Discharge is effected through a disengaging device 58 that separates a majority of the regenerated catalyst from the flue gas. The catalyst and gas exit downwardly from the disengaging device 58. The sudden loss of momentum and downward flow reversal cause a majority of the heavier catalyst to fall to the dense catalyst bed and the lighter flue gas and a minor portion of the catalyst still entrained therein to ascend upwardly in the upper chamber 60. Cyclones 62 further separate catalyst from ascending gas and deposits catalyst through dip legs into a dense catalyst bed. Flue gas exits the cyclones 62 through a gas conduit and collects in a plenum 64 for passage to an outlet nozzle of regenerator vessel 30. Catalyst densities in the dense catalyst bed are typically kept within a range of from about 640 to about 960 $kg/m^3$ (40 to 60 $lb/ft^3$).

The regenerator vessel 30 typically operates at a temperature of about 594° to about 704° C. (1100° to 1300° F.) in the lower chamber 54 and about 649° to about 760° C. (1200° to 1400° F.) in the upper chamber 60. Regenerated catalyst from dense catalyst bed is transported through regenerated catalyst pipe 32 from the regenerator vessel 30 back to the first reactor riser 26 through the control valve where it again contacts the first feed in line 24 as the FCC process continues. The first cracked product stream in the first cracked product line 46 from the first reactor 10, relatively free of catalyst particles and including the stripping fluid, exit the first reactor vessel 28 through an outlet nozzle. The first cracked products stream in the line 46 may be subjected to additional treatment to remove fine catalyst particles or to further prepare the stream prior to fractionation. The line 46 transfers the first cracked products stream to the FCC recovery zone 100, which is in downstream communication with the FCC zone 20. The FCC recovery zone 100 typically includes a main fractionation column and a gas recovery section. The FCC recovery zone can include many fractionation columns and other separation equipment. The FCC recovery zone 100 can recover a propylene product stream in propylene line 102, a light olefin stream in light olefin line 104, a gasoline stream in gasoline line 106, an aromatic naphtha stream in line 108 and an LCO stream in LCO line 109 among others from the cracked product stream in the first cracked product line 46. The light olefin stream in light olefin line 106 comprises an oligomerization feed stream having $C_4$ hydrocarbons including $C_4$ olefins and perhaps having $C_5$ hydrocarbons including $C_5$ olefins.

An FCC recycle line 280 delivers an FCC recycle stream to the FCC zone 20. The FCC recycle stream is directed into a first FCC recycle line 202 with the control valve 202' thereon opened. In an aspect, the FCC recycle stream may be directed into an optional second FCC recycle line 204 with the control valve 204' thereon opened. The first FCC recycle line 202 delivers the first FCC recycle stream to the first FCC reactor 22 in an aspect to the riser 26 at an elevation above the first hydrocarbon feed in line 24. The second FCC recycle line 204 delivers the second FCC recycle stream to the second FCC reactor 70. Typically, both control valves 202' and 204' will not be opened at the same time, so the FCC recycle stream goes through only one of the first FCC recycle line 202 and the second FCC recycle line 204. However, feed through both is contemplated.

It is desired that cyclic oligomerization products be aromatized in the FCC unit and aromatization will best take place in the first FCC reactor 22 with the larger pore catalyst. Consequently, feed that has been oligomerized over the ASA catalyst should preferentially be fed to the first FCC reactor 22. Feed that has been oligomerized over the SPA or zeolite catalyst to make larger olefins is most desirably cracked to lighter olefins such as propylene. Cracking to lighter olefins will most effectively occur in the second FCC reactor 70 if there is one. Consequently, feed that has been oligomerized over the SPA or the zeolite catalyst should preferentially be recycled to the second FCC reactor 70.

The second FCC recycle stream may be fed to the second FCC reactor 70 in the second FCC recycle line 204 via feed distributor 72. The second FCC reactor 70 may include a second riser 74. The second FCC recycle stream is contacted with catalyst delivered to the second riser 74 by a catalyst return pipe 76 to produce upgraded products. The catalyst may be fluidized by inert gas such as steam from distributor 78. Generally, the second FCC reactor 70 may operate under conditions to convert the second FCC recycle stream to second cracked products such as ethylene and propylene. A second reactor vessel 80 is in downstream communication with the second riser 74 for receiving second cracked products and catalyst from the second riser. The mixture of gaseous, second cracked product hydrocarbons and catalyst continues upwardly through the second reactor riser 74 and is received in the second reactor vessel 80 in which the catalyst and gaseous, second cracked products are separated. A pair of disengaging arms may tangentially and horizontally discharge the mixture of gas and catalyst from a top of the second reactor riser 74 through one or more outlet ports 82 (only one is shown) into the second reactor vessel 80 that effects partial separation of gases from the catalyst. The catalyst can drop to a dense catalyst bed within the second reactor vessel 80. Cyclones 84 in the second reactor vessel 80 may further separate catalyst from second cracked products. Afterwards, a second cracked product stream can be removed from the second reactor 84 through an outlet in a second cracked product line 86 in downstream communication with the second reactor riser 74. The second cracked product stream in line 86 is fed to the FCC recovery zone 100, preferably separately from the first cracked products to undergo separation and recovery of ethylene and propylene. Separated catalyst may be recycled via a recycle catalyst pipe 76 from the second reactor vessel 80 regulated by a control valve back to the second reactor riser 74 to be contacted with the second FCC recycle stream.

In some embodiments, the second FCC reactor 70 can contain a mixture of the first and second FCC catalysts as described above for the first FCC reactor 22. In one preferred embodiment, the second FCC reactor 70 can contain less than about 20 wt %, preferably less than about 5 wt % of the first FCC catalyst and at least 20 wt % of the second FCC catalyst. In another preferred embodiment, the second FCC reactor 70 can contain only the second FCC catalyst, preferably a ZSM-5 zeolite.

The second FCC reactor 70 is in downstream communication with the regenerator vessel 30 and receives regenerated catalyst therefrom in line 88. In an embodiment, the first FCC reactor 22 and the second FCC reactor 70 both share the same regenerator vessel 30. Line 90 carries spent catalyst from the second reactor vessel 80 to the lower chamber 54 of the regenerator vessel 30. The catalyst regenerator is in downstream communication with the second FCC reactor 70 via line 90.

The same catalyst composition may be used in both reactors 22, 70. However, if a higher proportion of the second FCC catalyst of small to medium pore zeolite is desired in the second FCC reactor 70 than the first FCC catalyst of large pore zeolite, replacement catalyst added to the second FCC reactor 70 may comprise a higher proportion of the second FCC catalyst. Because the second FCC catalyst does not lose activity as quickly as the first FCC catalyst, less of the second catalyst inventory must be forwarded to the catalyst regenerator 30 in line 90 from the second reactor vessel 80, but more catalyst inventory may be recycled to the riser 74 in return conduit 76 without regeneration to maintain a high level of the second FCC catalyst in the second reactor 70.

The second reactor riser 74 can operate in any suitable condition, such as a temperature of about 425° to about 705° C., preferably a temperature of about 550° to about 600° C., and a pressure of about 140 to about 400 kPa, preferably a pressure of about 170 to about 250 kPa. Typically, the residence time of the second reactor riser 74 can be less than about 3 seconds and preferably is than about 1 second. Exemplary risers and operating conditions are disclosed in, e.g., U.S. Pat. No. 7,491,315 and U.S. Pat. No. 7,261,807.

Before cracked products can be fed to the oligomerization zone 130, the light olefin stream in light olefin line 104 may require purification. Many impurities in the light olefin stream in light olefin line 104 can poison an oligomerization catalyst. Carbon dioxide and ammonia can attack acid sites on the catalyst. Sulfur containing compounds, oxygenates, and nitriles can harm oligomerization catalyst. Acetylene and diolefins can polymerize and produce gums on the catalyst or equipment. Consequently, the light olefin stream which comprises the oligomerization feed stream in light olefin line 104 may be purified in an optional purification zone 110.

The light olefin stream in light olefin line 104 may be introduced into an optional mercaptan extraction unit 112 to remove mercaptans to lower concentrations. In the mercaptan extraction unit 112, the light olefin feed may be prewashed in an optional prewash vessel containing aqueous alkali to convert any hydrogen sulfide to sulfide salt which is soluble in the aqueous alkaline stream. The light olefin stream, now depleted of any hydrogen sulfide, is contacted with a more concentrated aqueous alkali stream in an extractor vessel. Mercaptans in the light olefin stream react with the alkali to yield mercaptides. An extracted light olefin stream lean in mercaptans passes overhead from the extraction column and may be mixed with a solvent that removes COS in route to an optional COS solvent settler. COS may be removed with the solvent from the bottom of the settler, while the overhead light olefin stream may be fed to an optional water wash vessel to remove remaining alkali and produce a sulfur depleted light olefin stream in line 114. The mercaptide rich alkali from the extractor vessel receives an injection of air and a catalyst such as phthalocyanine as it passes from the extractor vessel to an oxidation vessel for regeneration. Oxidizing the mercaptides to disulfides using a catalyst regenerates the alkaline solution. A disulfide separator receives the disulfide rich alkaline from the oxidation vessel. The disulfide separator vents excess air and decants disulfides from the alkaline solution before the regenerated alkaline is drained, washed with oil to remove remaining disulfides and returned to the extractor vessel. Further removal of disulfides from the regenerated alkaline stream is also contemplated. The disulfides may be run through a sand filter and removed from the process. For more information on mercaptan extraction, reference may be made to U.S. Pat. No. 7,326,333.

In order to prevent polymerization and gumming in the oligomerization reactor that can inhibit equipment and catalyst performance, it is desired to minimize diolefins and acetylenes in the light olefin feed in line 114. Diolefin conversion to monoolefin hydrocarbons may be accomplished by selectively hydrogenating the sulfur depleted stream with a conventional selective hydrogenation reactor 116. Hydrogen may be added to the purified light olefin stream in line 118.

The selective hydrogenation catalyst can comprise an alumina support material preferably having a total surface area greater than 150 $m^2/g$, with most of the total pore volume of the catalyst provided by pores with average diameters of greater than 600 angstroms, and containing surface deposits of about 1.0 to 25.0 wt % nickel and about 0.1 to 1.0 wt % sulfur such as disclosed in U.S. Pat. No. 4,695,560. Spheres having a diameter between about 0.4 and 6.4 mm (1/64 and 1/4 inch) can be made by oil dropping a gelled alumina sol. The alumina sol may be formed by digesting aluminum metal with an aqueous solution of approximately 12 wt % hydrogen chloride to produce an aluminum chloride sol. The nickel component may be added to the catalyst during the sphere formation or by immersing calcined alumina spheres in an aqueous solution of a nickel compound followed by drying, calcining, purging and reducing. The nickel containing alumina spheres may then be sulfided. A palladium catalyst may also be used as the selective hydrogenation catalyst.

The selective hydrogenation process is normally performed at relatively mild hydrogenation conditions. These conditions will normally result in the hydrocarbons being present as liquid phase materials. The reactants will normally be maintained under the minimum pressure sufficient to maintain the reactants as liquid phase hydrocarbons which allow the hydrogen to dissolve into the light olefin feed. A broad range of suitable operating pressures therefore extends from about 276 (40 psig) to about 5516 kPa gauge (800 psig). A relatively moderate temperature between about 25° C. (77° F.) and about 350° C. (662° F.) should be employed. The liquid hourly space velocity of the reactants through the selective hydrogenation catalyst should be above 1.0 $hr^{-1}$. Preferably, it is between 5.0 and 35.0 $hr^{-1}$. The molar ratio of hydrogen to diolefinic hydrocarbons may be maintained between 1.5:1 and 2:1 and suitably between 1.5:1 and 1.8:1. The hydrogenation reactor is preferably a cylindrical fixed bed of catalyst through which the reactants move in a vertical direction.

A purified light olefin stream depleted of sulfur containing compounds, diolefins and acetylenes exits the selective hydrogenation reactor 116 in line 120. The optionally sulfur and diolefin depleted light olefin stream in line 120 may be introduced into an optional nitrile removal unit such as a water wash unit 122 to reduce the concentration of oxygenates and nitriles in the light olefin stream in line 120. Water is introduced to the water wash unit in line 124. An oxygenate and nitrile-rich aqueous stream in line 126 leaves the water wash unit 122 and may be further processed. A drier may follow the water wash unit 122.

A purified light olefin oligomerization feed stream perhaps depleted of sulfur containing compounds, diolefins and/or oxygenates and nitriles is provided in oligomerization feed stream line 128. The light olefin oligomerization feed stream in line 128 may be obtained from the cracked product stream in lines 46 and/or 86, so it may be in downstream communication with the FCC zone 20 and/or the FCC recovery zone 100. The oligomerization feed stream need not be obtained from a cracked FCC product stream but may come from another source such as a paraffin dehydrogenation process or a methanol to olefin process. The selective hydrogenation reactor 116 is in upstream communication with the oligomerization feed stream line 128. The oligomerization feed stream may comprise $C_4$ hydrocarbons such as butenes, i.e., $C_4$ olefins, and butanes. Butenes include normal butenes and isobutene. The oligomerization feed stream in oligomerization feed stream line 128 may comprise $C_5$ hydrocarbons such as pentenes, i.e., $C_5$ olefins, and pentanes. Pentenes include normal pentenes and isopentenes. Typically, the oligomerization feed stream will comprise about 20 to about 80 wt % olefins and suitably about 40 to about 75 wt % olefins. In an aspect, about 55 to about 75 wt % of the olefins may be butenes and about 25 to about 45 wt % of the olefins may be pentenes. Up to about 10 wt %, suitably 20 wt %, typically 25 wt % and most typically 30 wt % of the oligomerization feed may be $C_5$ olefins.

The oligomerization feed line 128 feeds the oligomerization feed stream to an oligomerization zone 130 which may be in downstream communication with the FCC recovery zone 100 and the FCC zone 20. The oligomerization feed stream in oligomerization feed line 128 may be mixed with an oligomerate recycle stream in line 226 prior to entering the oligomerization zone 130. The oligomerization feed line 128 is split into a first oligomerization feed stream in a first oligomerization feed conduit 132 and a second oligomerization feed stream in a second oligomerization feed conduit 134 at a split 136. Preferably, the split 136 may provide the first oligomerization feed stream and the second oligomerization feed stream in aliquot portions of equivalent compositions.

A first oligomerization reactor zone 140 is in downstream communication with the first oligomerization feed conduit 132, and a second oligomerization reactor zone 160 is in downstream communication with said second oligomerization feed conduit 134. A first conduit control valve 132' is situated on the first oligomerization feed conduit 132 and second conduit control valve 134' is situated on the second oligomerization feed conduit 134. The control valves can be opened to relatively different degrees to allow full, partial or no flow to each of the first oligomerization reactor zone 140 and the second oligomerization reactor zone 160. The first oligomerization feed conduit 132 bypasses the first oligomerization feed stream around the second oligomerization reactor zone 160, and the second oligomerization feed conduit 134 bypasses the second oligomerization feed stream around the first oligomerization reactor zone 140.

When the first conduit control valve 132' is opened to any degree it allows the first oligomerization feed stream to flow to the first oligomerization reactor zone 140 containing a first oligomerization catalyst and bypassing the first oligomerization feed stream around the second oligomerization reactor zone 160.

The first oligomerization feed stream in line 132 may comprise about 10 to about 50 wt % olefins and suitably about 25 to about 40 wt % olefins. Accordingly, the first oligomerization feed stream may comprise no more than about 38 wt % butene and in another aspect, the first oligomerization feed stream may comprise no more than about 23 wt % pentene. The first oligomerization feed stream to the first oligomerization zone in first oligomerization feed conduit 132 may comprise at least about 10 wt % butene, at least about 5 wt % pentene and preferably no more than about 1 wt % hexene. In a further aspect, the first oligomerization feed stream may comprise no more than about 0.1 wt % hexene and no more than about 0.1 wt % propylene. At least about 40 wt % of the butene in the first oligomerization feed stream may be normal butene. In an aspect, it may be that no more than about 70 wt % of the first oligomerization feed stream is normal butene. At least about 40 wt % of the pentene in the first oligomerization feed stream may be normal pentene. In an aspect, no more than about 70 wt % of the first oligomerization feed stream may be normal pentene.

The first oligomerization reactor zone 140 comprises a first oligomerization reactor 138. The first oligomerization reactor may be preceded by an optional guard bed for removing catalyst poisons that is not shown. When the first conduit control valve 132' is opened to any degree it allows the first oligomerization feed stream of $C_4$ olefins to flow to a first oligomerization reactor 138 through line 132. The first oligomerization feed stream is bypassed around a second oligomerization reactor containing a second oligomerization catalyst that has a different composition than the first oligomerization catalyst.

The first oligomerization reactor 138 contains the first oligomerization catalyst. A first oligomerization feed stream may be preheated before entering the first oligomerization reactor 138 in a first oligomerization reactor zone 140. The first oligomerization reactor 138 may contain a first catalyst bed 142 of first oligomerization catalyst. The first oligomerization reactor 138 may be an upflow reactor to provide a uniform feed front through the catalyst bed, but other flow arrangements are contemplated. In an aspect, the first oligomerization reactor 138 may contain an additional bed or beds 144 of first oligomerization catalyst. $C_4$ olefins in the first oligomerization feed stream oligomerize over the first oligomerization catalyst to provide an oligomerate comprising $C_4$ olefin dimers and trimers. $C_5$ olefins that may be present in the first oligomerization feed stream oligomerize over the first oligomerization catalyst to provide an oligomerate comprising $C_5$ olefin dimers and trimers and co-oligomerize with $C_4$ olefins to make $C_9$ olefins. The oligomerization produces other oligomers with additional carbon numbers.

Oligomerization effluent from the first bed 142 may optionally be quenched with a liquid such as recycled oligomerate before entering the additional bed 144, and/or oligomerization effluent from the additional bed 144 of first oligomerization catalyst may also be quenched with a liquid such as recycled oligomerate to avoid excessive temperature rise. The liquid oligomerate may also comprise oligomerized olefins that can react with the $C_4$ olefins and $C_5$ olefins in the feed and other oligomerized olefins if present to make heavier olefins. Oligomerized product, also known as oligomerate, exits the first oligomerization reactor 138 in line 146.

In an aspect, the first oligomerization reactor zone may include one or more additional first oligomerization reactors 150. The first oligomerization effluent may be heated and fed to the optional additional oligomerization reactor 150. It is contemplated that the first oligomerization reactor 138 and the additional first oligomerization reactor 150 may be operated in a swing bed fashion to take one reactor offline for maintenance or catalyst regeneration or replacement while the other reactor stays online. In an aspect, the additional first oligomerization reactor 150 may contain a first bed 152 of first oligomerization catalyst. The additional first oligomerization reactor 150 may also be an upflow reactor to provide a uniform feed front through the catalyst bed, but other flow arrangements are contemplated. In an aspect, the first additional oligomerization reactor 150 may contain an additional bed or beds 154 of first oligomerization catalyst. Remaining $C_4$ olefins in the first oligomerization feed stream oligomerize over the first oligomerization catalyst to provide an oligomerate comprising $C_4$ olefin dimers and trimers. Remaining $C_5$ olefins, if present in the first oligomerization feed stream, oligomerize over the first oligomerization catalyst to provide an oligomerate comprising $C_5$ olefin dimers and trimers and co-oligomerize with $C_4$ olefins to make $C_9$ olefins. Over 90 wt % of the $C_4$ olefins in the first oligomerization feed stream can oligomerize in the first oligomerization reactor zone 140. Over 90 wt % of the $C_5$ olefins in the first oligomerization feed stream can oligomerize in the first oligomerization reactor zone 140. If more than one first oligomerization reactor is used, conversion is achieved over all of the first oligomerization reactors 138, 150 in the first oligomerization reactor zone 140.

Oligomerization effluent from the first bed 152 may be quenched with a liquid such as recycled oligomerate before entering the additional bed 154 to avoid excessive temperature rise. The recycled oligomerate may also comprise oligomerized olefins that can react with the $C_4$ olefins and $C_5$ olefins in the feed and other oligomerized olefins to increase production of diesel range olefins.

A first oligomerate conduit 156, in downstream communication with the first oligomerization reactor zone 140, withdraws a first oligomerate stream from the first oligomerization reactor zone 140. The first oligomerate conduit 156 may be in downstream communication with the first oligomerization reactor 138 and the additional first oligomerization reactor 150.

The first oligomerization reactor zone 140 may contain a first oligomerization catalyst. The first oligomerization catalyst may comprise a zeolitic catalyst. The zeolite may comprise between 5 and 95 wt % of the catalyst. Suitable zeolites include zeolites having a structure from one of the following classes: MFI, MEL, SFV, SVR, ITH, IMF, TUN, FER, EUO, BEA, FAU, BPH, MEI, MSE, MWW, UZM-8, MOR, OFF, MTW, TON, MTT, AFO, ATO, and AEL. These three letter codes for structure types are assigned and maintained by the International Zeolite Association Structure Commission in the ATLAS OF ZEOLITE FRAMEWORK TYPES, which is at http://www.iza-structure.org/databases/. In a preferred aspect, the first oligomerization catalyst may comprise a zeolite with a framework having a ten-ring pore structure. Examples of suitable zeolites having a ten-ring pore structure include TON, MTT, MFI, MEL, AFO, AEL, EUO and FER. In a further preferred aspect, the first oligomerization catalyst comprising a zeolite having a ten-ring pore structure may comprise a uni-dimensional pore structure. A uni-dimensional pore structure indicates zeolites containing non-intersecting pores that are substantially parallel to one of the axes of the crystal. The pores preferably extend through the zeolite crystal. Suitable examples of zeolites having a ten-ring uni-dimensional pore structure may include MTT. In a further aspect, the first oligomerization catalyst comprises an MTT zeolite.

The first oligomerization catalyst may be formed by combining the zeolite with a binder, and then forming the catalyst into pellets. The pellets may optionally be treated with a phosphoric reagent to create a zeolite having a phosphorous component between 0.5 and 15 wt % of the treated catalyst. The binder is used to confer hardness and strength on the catalyst. Binders include alumina, aluminum phosphate, silica, silica-alumina, zirconia, titania and combinations of these metal oxides, and other refractory oxides, and clays such as montmorillonite, kaolin, palygorskite, smectite and attapulgite. A preferred binder is an aluminum-based binder, such as alumina, aluminum phosphate, silica-alumina and clays.

One of the components of the catalyst binder utilized in the present invention is alumina. The alumina source may be any of the various hydrous aluminum oxides or alumina gels such as alpha-alumina monohydrate of the boehmite or pseudo-boehmite structure, alpha-alumina trihydrate of the gibbsite structure, beta-alumina trihydrate of the bayerite structure, and the like. A suitable alumina is available from UOP LLC under the trademark Versal. A preferred alumina is available from Sasol North America Alumina Product Group under the trademark Catapal. This material is an extremely high purity alpha-alumina monohydrate (pseudo-boehmite) which after calcination at a high temperature has been shown to yield a high purity gamma-alumina.

A suitable oligomerization catalyst is prepared by mixing proportionate volumes of zeolite and alumina to achieve the desired zeolite-to-alumina ratio. In an embodiment, about 5 to about 80, typically about 10 to about 60, suitably about 15 to about 40 and preferably about 20 to about 30 wt % MTT zeolite and the balance alumina powder will provide a suitably supported catalyst. A silica support is also contemplated.

Monoprotic acid such as nitric acid or formic acid may be added to the mixture in aqueous solution to peptize the alumina in the binder. Additional water may be added to the mixture to provide sufficient wetness to constitute a dough with sufficient consistency to be extruded or spray dried. Extrusion aids such as cellulose ether powders can also be added. A preferred extrusion aid is available from The Dow Chemical Company under the trademark Methocel.

The paste or dough may be prepared in the form of shaped particulates, with the preferred method being to extrude the dough through a die having openings therein of desired size and shape, after which the extruded matter is broken into extrudates of desired length and dried. A further step of calcination may be employed to give added strength to the extrudate. Generally, calcination is conducted in a stream of air at a temperature from about 260° C. (500° F.) to about 815° C. (1500° F.). The MTT catalyst is not selectivated to neutralize surface acid sites such as with an amine.

The extruded particles may have any suitable cross-sectional shape, i.e., symmetrical or asymmetrical, but most often have a symmetrical cross-sectional shape, preferably a spherical, cylindrical or polylobal shape. The cross-sectional diameter of the particles may be as small as 40 μm; however, it is usually about 0.635 mm (0.25 inch) to about 12.7 mm (0.5 inch), preferably about 0.79 mm (1/32 inch) to about 6.35 mm (0.25 inch), and most preferably about 0.06 mm (1/24 inch) to about 4.23 mm (1/6 inch).

The first oligomerization catalyst may also be a solid phosphoric acid catalyst (SPA). The SPA catalyst refers to a solid catalyst that contains as a principal ingredient an acid of phosphorous such as ortho-, pyro- or tetraphosphoric acid. SPA catalyst is normally formed by mixing the acid of phosphorous with a siliceous solid carrier to form a wet paste. This paste may be calcined and then crushed to yield catalyst particles or the paste may be extruded or pelleted prior to calcining to produce more uniform catalyst particles. The carrier is preferably a naturally occurring porous silica-containing material such as kieselguhr, kaolin, infusorial earth and diatomaceous earth. A minor amount of various additives such as mineral talc, fuller's earth and iron compounds including iron oxide may be added to the carrier to increase its strength and hardness. The combination of the carrier and the additives preferably comprises about 15-30 wt % of the catalyst, with the remainder being the phosphoric acid. The additive may comprise about 3-20 wt % of the total carrier material. Variations from this composition such as a lower phosphoric acid content are possible. Further details as to the composition and production of SPA catalysts may be obtained from U.S. Pat. No. 3,050,472, U.S. Pat. No. 3,050,473 and U.S. Pat. No. 3,132,109 and from other references. Feed to the first oligomerization reactor zone 140 containing SPA catalyst as the first oligomerization catalyst should be kept dry except in an initial start-up phase.

The oligomerization reaction conditions in the first oligomerization reactors 138, 150 in the first oligomerization reactor zone 140 are set to keep the reactant fluids in the liquid phase. With liquid recycle, lower pressures are necessary to maintain liquid phase. Operating pressures include between about 2.1 MPa (300 psia) and about 10.5 MPa (1520 psia), suitably at a pressure between about 2.1 MPa (300 psia) and about 6.9 MPa (1000 psia) and preferably at a pressure between about 2.8 MPa (400 psia) and about 4.1 MPa (600 psia). Lower pressures may be suitable if the reaction is kept in the liquid phase. The temperature of the oligomerization conditions in the first oligomerization reactor zone 140 expressed in terms of a maximum bed temperature is in a range between about 150° C. and about 300° C. If the first oligomerization catalyst is SPA, the temperature of the first oligomerization reactor zone 140 is in a range between about 100° C. and about 250° C. and suitably between about 150° C. and about 200° C. The weight hourly space velocity should be between about 0.5 and about 5.0 $hr^{-1}$. Across a single bed of first oligomerization catalyst, the exothermic reaction will cause the temperature to rise. Consequently, the oligomerization reactor should be operated to allow the temperature at the outlet to be over about 25° C. greater than the temperature at the inlet.

The first oligomerization reactor with the first oligomerization catalyst can be run in high conversion mode of greater than 95% conversion of feed olefins to produce a high quality diesel product and gasoline product. Normal butene conversion can exceed about 80%. Additionally, normal pentene conversion can exceed about 80%.

When the second conduit control valve 134' is opened to any degree it allows a second oligomerization feed stream of $C_4$ olefins to flow to the second oligomerization reactor zone 160 containing a second oligomerization catalyst and bypassing the second oligomerization feed stream around the first oligomerization reactor zone 140. The second oligomerization catalyst is different from the first oligomerization catalyst in composition not considering degree of coking, impurity adsorption or days on stream. The second oligomerization feed stream may have the same range of composition as the first oligomerization feed stream in line 132.

The second oligomerization reactor zone 160 comprises a second oligomerization reactor 162. When the second conduit control valve 134' is opened to any degree it allows the second oligomerization feed stream of $C_4$ olefins to flow to a second oligomerization reactor 162 containing the second oligomerization catalyst and bypassing the second oligomerization feed stream around the first oligomerization reactor 138 containing the first oligomerization catalyst that has a different composition than the second oligomerization catalyst. The second oligomerization feed stream may be preheated before entering the second oligomerization reactor 162 in the second oligomerization reactor zone 160. The second oligomerization reactor 162 may contain a first catalyst bed 164 of second oligomerization catalyst. The second oligomerization reactor 162 may be an upflow reactor to provide a uniform feed front through the catalyst bed, but other flow arrangements are contemplated. In an aspect, the second oligomerization reactor 162 may contain an additional bed or beds 166 of second oligomerization catalyst. $C_4$ olefins in the second oligomerization feed stream oligomerize over the second oligomerization catalyst to provide an oligomerate comprising $C_4$ olefin dimers and trimers. $C_5$ olefins that may be present in the second oligomerization feed stream oligomerize over the second oligomerization catalyst to provide an oligomerate comprising $C_5$ olefin dimers and trimers and co-oligomerize with $C_4$ olefins to make $C_9$ olefins. The oligomerization produces other oligomers with additional carbon numbers. Oligomerization effluent from the first bed 164 may be quenched with a liquid such as recycled oligomerate before entering the additional bed 166, and/or oligomerization effluent from the additional bed 166 of second oligomerization catalyst may also be quenched to avoid excessive temperature rise. If oligomers are recycled to the second oligomerization reactor 162, further oligomerization occurs with $C_4$ or $C_5$ olefins or with other oligomers to increase production of distillate olefins. Oligomerized product, also known as oligomerate, exits the second oligomerization reactor 162 in line 168.

In an aspect, the second oligomerization reactor zone 160 may include one or more additional second oligomerization reactors 170. The second oligomerization effluent may be heated and fed to the optional additional second oligomerization reactor 170. It is contemplated that the second oligomerization reactor 162 and the additional second oligomerization reactor 170 may be operated in a swing bed fashion to take one reactor offline for maintenance or catalyst regeneration or replacement while the other reactor stays online. In an aspect, the additional second oligomerization reactor 170 may contain a first bed 172 of second oligomerization catalyst. The additional second oligomerization reactor 170 may also be an upflow reactor to provide a uniform feed front through the catalyst bed, but other flow arrangements are contemplated. In an aspect, the second additional oligomerization reactor 170 may contain an additional bed or beds 174 of second oligomerization catalyst. Remaining $C_4$ olefins in the second oligomerization feed stream oligomerize over the second oligomerization catalyst to provide $C_4$ olefin dimers and trimers. Over 90 wt % of the $C_4$ olefins in the second oligomerization feed stream can oligomerize in the second oligomerization reactor zone 160. Over 90 wt % of the $C_5$ olefins in the second oligomerization feed stream can oligomerize in the second oligomerization reactor zone 160. If more than one second oligomerization reactor is used, conversion is achieved over all of the second oligomerization reactors 162, 170 in the second oligomerization reactor zone 160. Oligomerization effluent from the second bed 172 may be quenched with a liquid such as recycled oligomerate before entering the additional bed 174, to avoid excessive temperature rise. If oligomers are recycled to the additional second oligomerization reactor 170, further oligomerization occurs with $C_4$ or $C_5$ olefins or with other oligomers to increase production of distillate olefins. A second oligomerate conduit 176 in communication with the second oligomerization reactor zone 160 withdraws a second oligomerate from the second oligomerization reactor zone 160 comprising heavier olefins. The second oligomerate conduit 176 is in downstream communication with the second oligomerization reactor 162 and the additional second oligomerization reactor 170.

The second oligomerization catalyst may be a supported amorphous silica alumina (ASA) catalyst. ASA's are solid catalysts having an acid function which are comprised of intimately mixed $SiO_2$ and $Al_2O_3$. ASA's for the present invention may have a Low Temperature Acidity Ratio of at least about 0.15, suitably of at least about 0.2, and preferably at least about 0.25, as determined by Ammonia Temperature Programmed Desorption (Ammonia TPD) as described hereinafter. ASA's useful for the present invention include those with a weight ratio of silica-to-alumina in the range of at least 0.5:1 (33 wt %) up to as high as 9:1 (90 wt %).

One of the components of the catalyst support utilized in the present invention is alumina. The alumina may be any of the various hydrous aluminum oxides or alumina gels such as alpha-alumina monohydrate of the boehmite or pseudo-boehmite structure, alpha-alumina trihydrate of the gibbsite structure, beta-alumina trihydrate of the bayerite structure, and the like. A particularly preferred alumina is available from Sasol North America Alumina Product Group under the trademark Catapal. This material is an extremely high purity alpha-alumina monohydrate (pseudo-boehmite) which after calcination at a high temperature has been shown to yield a high purity gamma-alumina. Another component of the catalyst is an amorphous silica-alumina. A suitable silica-alumina with a silica-to-alumina ratio of 2.6 is available from CCIC, a subsidiary of JGC, Japan.

A suitable silica-alumina mixture is prepared by mixing proportionate volumes of silica-alumina and alumina to achieve the desired silica-to-alumina ratio. In an embodiment, 85 wt % amorphous silica-alumina with a silica-to-alumina ratio of 2.6 and 15 wt % alumina powders will provide a suitable support. In an embodiment, ratios other than 85-to-15 of amorphous silica-alumina to alumina may be suitable, so long as the final silica-to-alumina weight ratio of the support is suitably no more than 30 and preferably no more than 20.

Monoprotic acid such as nitric acid or formic acid may be added to the mixture in aqueous solution to peptize the alumina in the binder. Additional water may be added to the mixture to provide sufficient wetness to constitute a dough with sufficient consistency to be extruded or spray dried.

The paste or dough may be prepared in the form of shaped particulates, with the preferred method being to extrude the dough mixture of alumina, silica-alumina, surfactant and water through a die having openings therein of desired size and shape, after which the extruded matter is cut into extrudates of desired length and dried. A further step of calcination may be employed to give added strength to the extrudate. Generally, calcination is conducted in a stream of dry air at a temperature from about 260° C. (500° F.) to about 815° C. (1500° F.).

The extruded particles may have any suitable cross-sectional shape, i.e., symmetrical or asymmetrical, but most often have a symmetrical cross-sectional shape, preferably a spherical, cylindrical or polylobal shape. The cross-sectional diameter of the particles may be as small as 40 μm (0.002 inch); however, it is usually about 0.635 mm (0.25 inch) to about 12.7 mm (0.5 inch), preferably about 0.79 mm (1/32 inch) to about 6.35 mm (0.25 inch), and most preferably about 0.06 mm (1/24 inch) to about 4.23 mm (1/6 inch). Among the preferred catalyst configurations are cross-sectional shapes resembling that of a three-leaf clover, as shown, for example, in FIGS. 8 and 8A of U.S. Pat. No. 4,028,227. Preferred clover-shaped particulates are such that each "leaf" of the cross-section is defined by about a 270° arc of a circle having a diameter between about 0.51 mm (0.02 inch) and 1.27 mm (0.05 inch). Other preferred particulates are those having quadralobal cross-sectional shapes, including asymmetrical shapes, and symmetrical shapes such as in FIG. 10 of U.S. Pat. No. 4,028,227.

Typical characteristics of the supported amorphous silica-alumina catalysts utilized herein are a total pore volume, average pore diameter and surface area large enough to provide substantial space and area for reactivity. The total pore volume of the support, as measured by conventional mercury porosimeter methods, is usually about 0.2 to about 2.0 cc/gram, preferably about 0.25 to about 1.0 cc/gram and most preferably about 0.3 to about 0.9 cc/gram. Ordinarily, the amount of pore volume of the support in pores of diameter greater than 100 angstroms is less than about 0.1 cc/gram, preferably less than 0.08 cc/gram, and most preferably less than about 0.05 cc/gram. Surface area, as measured by the B.E.T. method, is typically above 50 $m^2$/gram, e.g., at least about 200 $m^2$/gram, preferably at least about 250 $m^2$/gram, and most preferably about 300 $m^2$/gram to about 400 $m^2$/gram.

The Ammonia Temperature Programmed Desorption (Ammonia TPD) test involves first heating about a 250 milligram sample of catalyst at a rate of about 5° C. per minute to a temperature of about 550° C. in the presence of 20 volume percent oxygen in helium atmosphere at a flow rate of about 100 milliliters per minute. After a hold of about one hour, helium is used to flush the system for about 15 minutes and the sample is cooled to about 150° C. The sample is then saturated with pulses of ammonia in helium at about 40 milliliters per minute. The total amount of ammonia used is greatly in excess of the amount required to saturate all the acid sites on the sample. The sample is purged with helium at about 40 milliliters per minute for about 8 hours to remove physisorbed ammonia. With the helium purge continuing, the temperature is increased at a rate of about 10° C. per minute to a final temperature of 600° C. The amount of ammonia desorbed is monitored using a calibrated thermal conductivity detector. The total amount of ammonia is determined by integration.

The ratio of the total amount of ammonia desorbed to the dry weight of the sample yields the Total Acidity. As used herein, values of Total Acidity are given in units of millimoles of ammonia per gram of dry sample. Suitable second oligomerization catalysts are acidic, that is, having a Total Acidity of at least about 0.15, and preferably at least about 0.25, as determined by Ammonia TPD.

The ratio of the total amount of ammonia desorbed from the sample prior to reaching a temperature of 300° C. to the dry weight of the sample yields the Low Temperature Peak. As used herein, values of the Low Temperature Peak are given in units of millimoles of ammonia per gram of dry sample. Suitable second oligomerization catalysts have a Low Temperature Peak, that is having a Low Temperature Peak of at least about 0.05, and preferably at least about 0.06, as determined by Ammonia TPD.

The ratio of the Low Temperature Peak to the Total Acidity gives a unit-less ratio known as Low Temperature Acidity Ratio. Suitable second oligomerization catalysts have a Low Temperature Acidity Ratio of at least 0.15, suitably at least 0.2, and preferably greater than 0.25, as determined by Ammonia TPD.

An alternative second oligomerization catalyst suitable for the present invention utilizes a co-gelled silica-alumina support made by the well-known oil-drop method which permits the utilization of the support in the form of macrospheres. For example, an alumina sol, utilized as an alumina source, is commingled with an acidified water glass solution as a silica source, and the mixture is further commingled with a suitable gelling agent, for example, urea, hexamethylenetetramine, or mixtures thereof. The mixture is discharged while still below gellation temperature, and by means of a nozzle or rotating disk, into a hot oil bath maintained at gellation temperature. The mixture is dispersed into the oil bath as droplets which form into spheroidal gel particles during passage therethrough. The alumina sol is preferably prepared by a method wherein aluminum pellets are commingled with a quantity of treated or deionized water, with hydrochloric acid being added thereto in a sufficient amount to digest a portion of the aluminum metal and form the desired sol. A suitable reaction rate is effected at about reflux temperature of the mixture.

The spheroidal gel particles prepared by the oil-drop method are aged, usually in the oil bath, for a period of at least 10 to 16 hours, and then in a suitable alkaline or basic medium for at least 3 to about 10 hours, and finally water-washed. Proper gellation of the mixture in the oil bath, as well as subsequent aging of the gel spheres, can be accomplished at least at about 48.9° C. (120° F.), and suitably at less than about 98.9° C. (210° F.), at which or above the rapid evolution of the gases tend to rupture and otherwise weaken the spheres. By maintaining sufficient superatmospheric pressure during the forming and aging steps in order to maintain water in the liquid phase, a higher temperature can be employed, frequently with improved results. If the gel particles are aged at superatmospheric pressure, no alkaline aging step is required.

The spheres are water-washed, preferably with water containing a small amount of ammonium hydroxide and/or ammonium nitrate. After washing, the spheres are dried, at a temperature of from about 93.3° C. (200° F.) to about 315° C. (600° F.) for a period of from about 6 to about 24 hours or more, and then calcined at a temperature of from about 426.67° C. (800° F.) to about 760° C. (1400° F.) for a period of from 2 to about 12 hours or more.

With liquid oligomerate recycle, lower pressures are necessary to maintain liquid phase. Operating pressures in the second oligomerization reaction zone 160 include between about 2.1 MPa (305 psia) and about 10.5 MPa (1520 psia), suitably at a pressure between about 2.1 MPa (300 psia) and about 6.9 MPa (1000 psia) and preferably at a pressure between about 2.8 MPa (400 psia) and about 4.1 MPa (600 psia). Lower pressures may be suitable if the reaction is kept in the liquid phase. Both oligomerization reaction zones 140 and 160 may be run at the same pressure. The temperature of the oligomerization conditions in the second oligomerization reactor zone 160 expressed in terms of a maximum bed temperature is in a range between about 150° C. and about 300° C. The liquid hourly space velocity (LHSV) should be between about 0.5 and about 5 $hr^{-1}$. Across a single bed of second oligomerization catalyst, the exothermic reaction will cause the temperature to rise at least 25° C. The second oligomerization reactor zone 160 may be operated in high conversion mode of greater than 95% conversion of feed olefins.

The oligomerate produced in the second oligomerization reactor zone 160 by the second oligomerization catalyst comprises a greater concentration of naphthenes than in the first oligomerization reactor zone 140 over the first oligomerization catalyst. The selectivity to naphthenes and/or cyclic hydrocarbons is greater in the second oligomerization reactor zone 160 than in the first oligomerization reactor zone 140.

An oligomerate line 180 may remove an oligomerate stream from the first oligomerization reactor zone 140 and/or the second oligomerization reactor zone 160. A joint on the oligomerate line 180 provides communication between the first oligomerate conduit 156 and the second oligomerate conduit 176 with the oligomerate line 180. The first oligomerate conduit 156 is in downstream communication with the first oligomerization reactor zone 140, and the second oligomerate conduit 176 is in downstream communication with second oligomerization reactor zone 160.

The oligomerization zone 130 can be operated with the first oligomerization reactor zone 140 and the second oligomerization reactor zone 160 running in parallel. It is envisioned that the zeolitic catalyst or SPA be the first oligomerization catalyst loaded into the first oligomerization reactor zone 140 and the ASA catalyst be the second oligomerization catalyst loaded into the second oligomerization reactor zone 160.

In an alternative embodiment, the first oligomerization reactor zone 140 and the second oligomerization reactor zone 160 can also be run in series or even be contained in the same reactor vessel. The process may only utilize the first oligomerization reactor zone 140, but the first oligomerization reactor 138 may contain the first oligomerization catalyst or the second oligomerization catalyst and the other first oligomerization reactor 150 may contain the other of the first oligomerization catalyst and the second oligomerization catalyst. It is also contemplated to provide a bed of the first oligomerization catalyst and a bed of the second oligomerization catalyst in the same reactor. It is also contemplated to provide the first oligomerization catalyst and the second oligomerization catalyst in the same bed.

Operation of the oligomerization zone 130 can be conducted with flexibility. All or a portion of the flow of the first oligomerization feed stream flowing to the first oligomerization reactor zone 140 can be stopped. All or a portion of the first oligomerization feed stream can be diverted to the second oligomerization reactor zone 160 while bypassing the all or a portion of the first oligomerization feed stream around the first oligomerization reactor zone 140. Additionally, all or a portion of the flow of the second oligomerization feed stream flowing to the second oligomerization reactor zone 160 can be stopped. All or a portion of the second oligomerization feed stream can be diverted to the first oligomerization reactor zone 140 while bypassing the all or a portion of the second oligomerization feed stream around the second oligomerization reactor zone 160.

The flow rate directed to each oligomerization reactor zone can be set to achieve the flow rate of oligomerate product desired. The first oligomerization reactor zone and the second oligomerization reactor zone may operate at over 95% conversion of feed olefins to achieve the high quality oligomerate product desired. The feed can be split between the first oligomerization reactor zone 140 and the second oligomerization reactor zone 160 or all the feed can be run through just one of the oligomerization reactor zones 140 or 160 depending on the refiner's needs. By running the oligomerization reactors in this manner, the process always has a backup reactor during downtimes. The oligomerization zone 130 can always be running. While one oligomerization reactor zone 140 or 160 is being reloaded or regenerated, the other reaction zone or reactor can still be used to oligomerize product. The feed to each oligomerization reactor zone can be varied to achieve the quantity of gasoline or distillate or cyclic product desired, giving the refiner flexibility in achieving the product quality goals.

An oligomerization recovery zone 200 is in downstream communication with the oligomerization zone 130, the oligomerate line 180 and the first oligomerate conduit 156 and the second oligomerate conduit 176. The oligomerate line 180 removes the oligomerate stream from the oligomerization zone 130. A product stream may be separated from the first oligomerate stream in line 156 and a second oligomerate stream in line 176 together.

The oligomerization recovery zone 200 may include a debutanizer column 210 which separates the oligomerate stream between vapor and liquid into a first vaporous oligomerate overhead light stream comprising $C_4$ olefins and hydrocarbons in a first overhead line 212 and a first liquid oligomerate bottom stream comprising $C_5$+ olefins and hydrocarbons in a first bottom line 214. When maximum production of distillate is desired to recrack the diesel in the FCC zone 20 to make more propylene, the overhead pressure in the debutanizer column 210 may be between about 300 and about 700 kPa (gauge) and the bottom temperature may be between about 225 and about 300° C. When maximum production of gasoline is desired to convert cyclic to aromatics in the FCC zone, the overhead pressure in the debutanizer column 210 may be between about 300 and about 700 kPa (gauge) and the bottom temperature may be between about 175 and about 225° C. The first vaporous oligomerate overhead light stream comprising $C_4$ hydrocarbons may be rejected from the process and subjected to further processing to recover useful components.

It is desired to maintain liquid phase in the oligomerization reactors. This is typically achieved by saturating product olefins and recycling them to the oligomerization reactor as a liquid. However, if olefinic product is being recycled to either the FCC zone 20 or the oligomerization zone 130, saturating olefins would inactivate the recycle feed. The oligomerization zone 130 can only further oligomerize olefinic recycle and the FCC zone 20 prefers olefinic feed to be further cracked to form propylene.

Liquid phase may be maintained in the oligomerization zone 130 by incorporating into the feed a $C_5$ stream from the oligomerization recovery zone 200. The oligomerization recovery zone 200 may include a depentanizer column 220 to which the first liquid oligomerate bottom stream comprising $C_5$+ hydrocarbons may be fed in line 214. The depentanizer column 220 may separate the first liquid oligomerate bottom stream between vapor and liquid into an intermediate stream comprising $C_5$ olefins and hydrocarbons in an intermediate line 222 and a liquid oligomerate bottom product stream comprising $C_6$+ olefins in a bottom product line 224. When maximum production of distillate is desired to recrack the diesel in the FCC zone 20 to make more propylene, the overhead pressure in the depentanizer column 220 may be between about 50 and about 100 kPa (gauge) and the bottom temperature may be between about 200° and about 275° C. When maximum production of gasoline cyclics for conversion to aromatics is desired, the overhead pressure in the depentanizer column 220 may be between about 100 and about 500 kPa (gauge) and the bottom temperature may be between about 150° and about 225° C.

The intermediate stream in intermediate line 222 may comprise at least 70 wt % and suitably at least 90 wt % $C_5$ hydrocarbons which can then act as a solvent in the oligomerization zone 130 to maintain liquid phase therein. The overhead intermediate stream comprising $C_5$ hydrocarbons may have less than 10 wt % $C_4$ or $C_6$ hydrocarbons and may preferably have less than 1 wt % $C_4$ or $C_6$ hydrocarbons. However, it is also contemplated that the split in the depentanizer column be adjusted, so the overhead stream would have more heavier hydrocarbons.

The intermediate stream may be condensed and recycled to the oligomerization zone 130 as a first intermediate recycle stream in an intermediate recycle line 226 to maintain the liquid phase in the oligomerization reactors 138, 150, 162, 170 operating in the oligomerization zone 130. The $C_5$ overhead stream may comprise $C_5$ olefins that can oligomerize in the oligomerization zone. The $C_5$ hydrocarbon presence in the oligomerization zone maintains the oligomerization reactors at liquid phase conditions. The pentanes are easily separated from the heavier olefinic product such as in the depentanizer column 220. The pentane recycled to the oligomerization zone also dilutes the feed olefins to help limit the temperature rise within the reactor due to the exothermicity of the reaction.

We have found that dimethyl sulfide boils with the $C_5$ hydrocarbons and deactivates the unidimensional, 10-ring pore structured zeolite which may be the first oligomerization catalyst. The mercaptan extraction unit 112 does not remove sufficient dimethyl sulfide to avoid deactivating the first oligomerization catalyst. Consequently, recycle of $C_5$ hydrocarbons to the first oligomerization reactor zone 140 with first oligomerization catalyst comprising a unidimensional, 10-ring pore structured zeolite should be avoided unless dimethyl sulfide can be successfully removed from the oligomerate stream. However, the dimethyl sulfide does not substantially harm the solid phosphoric acid catalyst or the ASA catalyst, so recycle of $C_5$ hydrocarbons to oligomerization reactor zone 160 with such catalysts is suitable.

In an aspect, the intermediate stream in the intermediate line 222 comprising $C_5$ hydrocarbons may be split into a purge stream in purge line 228 and the first intermediate recycle stream comprising $C_5$ hydrocarbons in the first intermediate recycle line 226. In an aspect, the first intermediate recycle stream in first intermediate recycle line 226 taken from the intermediate stream in intermediate line 222 is recycled to the oligomerization zone 130 downstream of the selective hydrogenation reactor 116. The first intermediate recycle stream in intermediate recycle line 226 should be understood to be a condensed overhead stream. The intermediate recycle stream comprising $C_5$ hydrocarbons may be recycled to the oligomerization zone 130 at a mass flow rate which is at least as great as and suitably no greater than three times the mass flow rate of the oligomerization feed stream in the oligomerization feed line 128 fed to said oligomerization zone 130. The recycle rate may be adjusted as necessary to maintain liquid phase in the oligomerization reactors and to control temperature rise, and to maximize selectivity to gasoline range oligomer products.

The purge stream comprising $C_5$ hydrocarbons taken from the intermediate stream may be purged from the process in line 228 to avoid $C_5$ paraffin build up in the process. The purge stream comprising $C_5$ hydrocarbons in line 228 may be subjected to further processing to recover useful components or be blended in the gasoline pool.

Two streams may be taken from the liquid oligomerate bottom product stream in bottom product line 224. The FCC recycle stream comprising $C_6$+ olefins in an FCC recycle line 280 may be taken from the liquid oligomerate bottom product stream in bottom product line 224. The liquid oligomerate bottom product stream in the bottom product line 224 may have greater than 10 wt % $C_{10}$ isoolefins. Flow through FCC recycle line 280 can be regulated by control valve 280'. Accordingly, a product stream in bottom product line 224 may be separated from the oligomerate stream in oligomerate line 180 and at least a portion of it may be cracked in the FCC unit 20. In another aspect, oligomerate product can be recovered in oligomerate product line 230 regulated by control valve 230' and sent for further recovery or motor fuel blending.

If a refiner desires to make additional propylene or aromatics in the FCC unit, the FCC recycle line 280 will carry the FCC recycle oligomerate stream as feed to the FCC zone 20. In an aspect, the FCC recycle line 280 is in upstream communication with the FCC reaction zone 20 to recycle oligomerate for fluid catalytic cracking down to propylene or other light olefins or conversion of cyclic to aromatics.

If the FCC zone 20 comprises a single reactor riser 26, the first reactor riser 26 may be in downstream communication with the hydrocarbon feed line 24 and the FCC recycle line 280. If the FCC zone 20 comprises the first reactor riser 26 and a second reactor riser 74, the first reactor riser 26 may be in downstream communication with the hydrocarbon feed line 24 and the second reactor riser 74 may be in downstream communication with the FCC recycle line 230 when the oligomerization feed in line 128 is fed to the first oligomerization reactor zone 140.

We have found that $C_6$+ oligomerate subjected to FCC processing is converted to light olefins best over a blend of medium or smaller pore zeolite blended with a large pore zeolite such as Y zeolite as explained previously with respect to the FCC zone 20. Additionally, oligomerate produced over the first oligomerization catalyst in the first oligomerization reactor zone 140 provides an excellent feed to the FCC zone that can be cracked to yield greater quantities of propylene. Moreover, oligomerate produced over the second oligomerization catalyst in the second oligomerization reactor zone 160 provides an excellent feed comprising naphthenes that in the FCC zone can be converted to aromatics. Oligomerate from the second oligomerization reactor zone 160 has a greater selectivity to naphthenes than feed oligomerized over a catalyst not comprising amorphous silica alumina and when cracked in the FCC unit 20 converts to single-ring aromatics with a greater selectivity than feed oligomerized over catalyst not comprising amorphous silica alumina. At least 5 wt % more single-ring aromatics can be produced in the FCC unit with oligomerate produced over amorphous silica alumina catalyst than produced over another oligomerization catalyst based on the feed to the second oligomerization reactor zone 160.

Accordingly, If the FCC zone 20 comprises the first reactor riser 26 and a second reactor riser 74, the first reactor riser 26 is preferably in downstream communication with the hydrocarbon feed line 24 and the FCC recycle line 280 when the oligomerization feed in line 128 is fed to the second oligomerization reactor zone 140.

The invention will now be further illustrated by the following non-limiting examples.

EXAMPLES

Example 1

Feed 1 in Table 1 was contacted with four catalysts to determine their effectiveness in oligomerizing butenes.

TABLE 1

| Component | Fraction, wt % |
|---|---|
| propylene | 0.1 |
| Iso-$C_4$'s | 70.04 |
| isobutylene | 7.7 |
| 1-butene | 5.7 |
| 2-butene (cis and trans) | 16.28 |
| 3-methyl-1-butene | 0.16 |
| acetone | 0.02 |
| Total | 100 |

Catalyst A is an MTT catalyst purchased from Zeolyst having a product code Z2K019E and extruded with alumina to be 25 wt % zeolite. Of MTT zeolite powder, 53.7 grams was combined with 2.0 grams Methocel and 208.3 grams Catapal B boehmite. These powders were mixed in a muller before a mixture of 18.2 g $HNO_3$ and 133 grams distilled water was added to the powders. The composition was blended thoroughly in the muller to effect an extrudable dough of about 52% LOI. The dough then was extruded through a die plate to form cylindrical extrudates having a diameter of about 3.18 mm. The extrudates then were air dried, and calcined at a temperature of about 550° C. The MTT catalyst was not selectivated to neutralize acid sites such as with an amine.

Catalyst B is a SPA catalyst commercially available from UOP LLC.

Catalyst C is an MTW catalyst with a silica-to-alumina ratio of 36:1. Of MTW zeolite powder made in accordance with the teaching of U.S. Pat. No. 7,525,008, 26.4 grams was combined with and 135.1 grams Versal 251 boehmite. These powders were mixed in a muller before a mixture of 15.2 grams of nitric acid and 65 grams of distilled water were added to the powders. The composition was blended thoroughly in the muller to effect an extrudable dough of about 48% LOI. The dough then was extruded through a die plate to form cylindrical extrudates having a diameter of about 1/32". The extrudates then were air dried and calcined at a temperature of about 550° C.

Catalyst D is an MFI catalyst purchased from Zeolyst having a product code of CBV-8014 having a silica-to-alumina ratio of 80:1 and extruded with alumina at 25 wt % zeolite. Of MFI-80 zeolite powder, 53.8 grams was combined with 205.5 grams Catapal B boehmite and 2 grams of Methocel. These powders were mixed in a muller before a mixture of 12.1 grams nitric acid and 115.7 grams distilled water were added to the powders. The composition was blended thoroughly in the muller, then an additional 40 grams of water was added to effect an extrudable dough of about 53% LOI. The dough then was extruded through a die plate to form cylindrical extrudates having a diameter of about 3.18 mm. The extrudates then were air dried, and calcined at a temperature of about 550° C.

Figure 2:
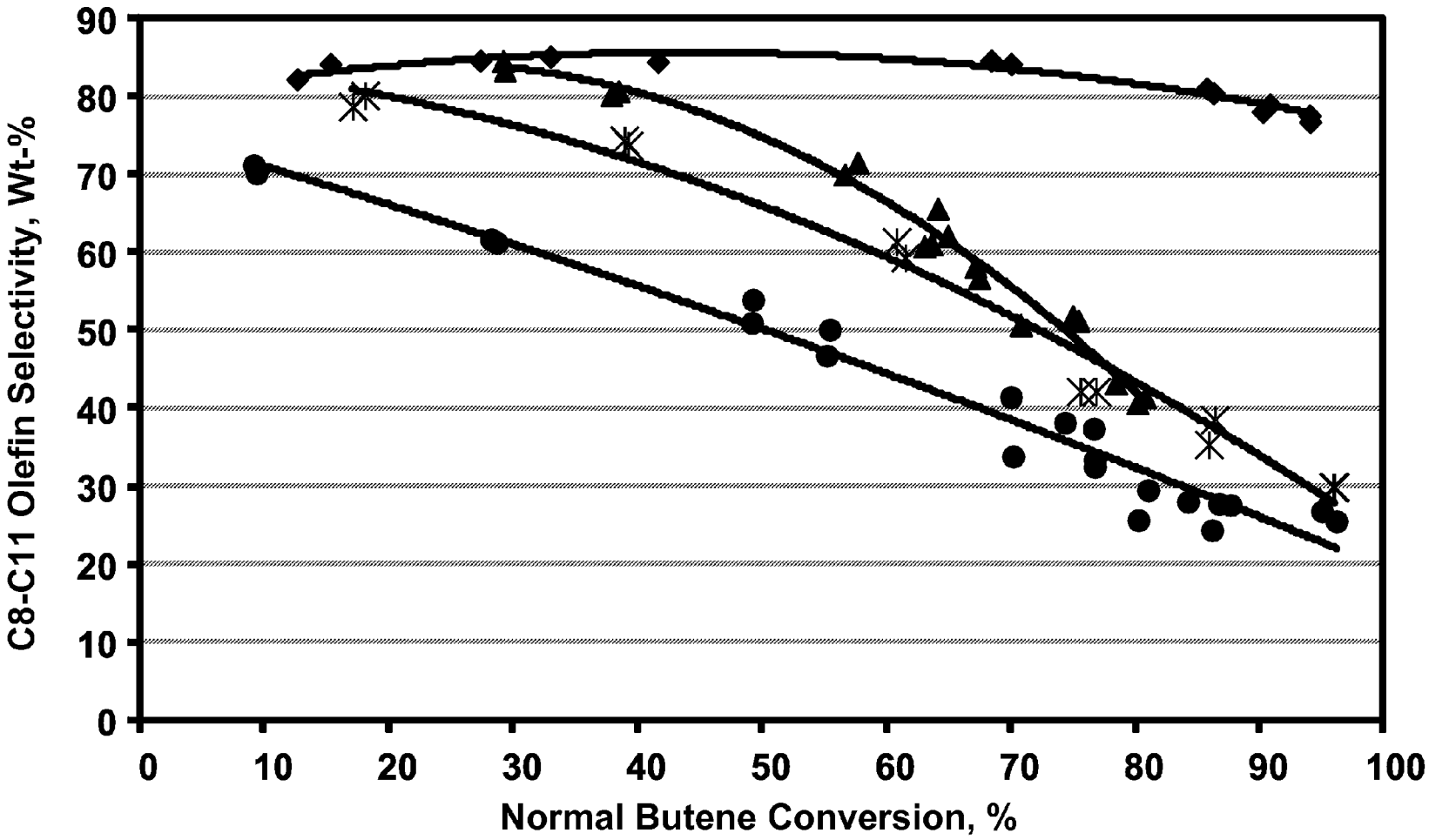
FIG. 2 is a plot of $C_8$-$C_{11}$ olefin selectivity versus normal butene conversion.
Figure 3:
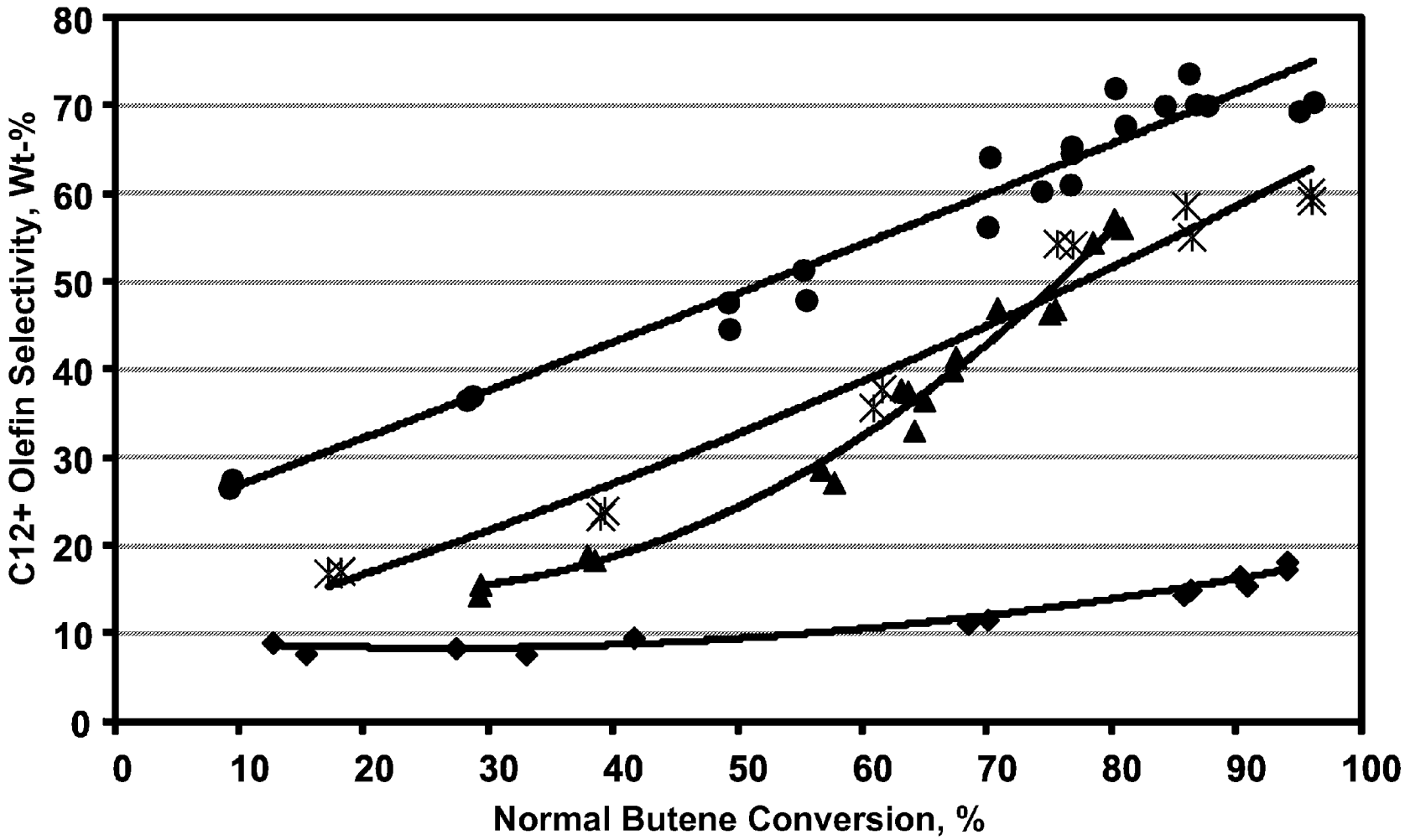
FIG. 3 is a plot of $C_{12}$+ olefin selectivity versus normal butene conversion.

The experiments were operated at 6.2 MPa and inlet temperatures at intervals between 160 and 240° C. to obtain different normal butene conversions. Results are shown in FIGS. 2 and 3. In FIG. 2, $C_8$ to $C_{11}$ olefin selectivity is plotted against normal butene conversion to provide profiles for each catalyst.

Table 2 compares the RONC ±3 for each product by catalyst and provides a key to FIG. 2. The RONC was determined for the composite product for each catalyst run per ASTM D2699. The SPA catalyst B is superior for selectivity to gasoline, but the MTT catalyst A is the least effective in selectively producing gasoline range olefins.

TABLE 2

| Catalyst | | | RONC |
|---|---|---|---|
| A | MTT | circles | 92 |
| B | SPA | diamonds | 96 |
| C | MTW | triangles | 97 |
| D | MFI-80 | asterisks | 95 |

The SPA catalyst was able to achieve over 95 wt % yield of gasoline having a RONC of >95 and with an Engler T90 value of 185° C. for the entire product. The T-90 gasoline specification is less than 193° C.

In FIG. 3, $C_{12}$+ olefin selectivity is plotted against normal butene conversion to provide profiles for each catalyst. Table 3 compares the derived cetane number ±2 for each product by catalyst and provides a key to FIG. 3. The cetane number was determined for the composite product for each catalyst run per ASTM D6890.

TABLE 3

| Catalyst | | | Cetane |
|---|---|---|---|
| A | MTT | circles | 41 |
| B | SPA | diamonds | <14 |
| C | MTW | triangles | 28 |
| D | MFI-80 | asterisks | 36 |

FIG. 3 shows that the MTT catalyst provides the highest $C_{12}$+ olefin selectivity which reaches over 70 wt %. These selectivities are from a single pass of the feed stream through the oligomerization reactor. Additionally, the MTT catalyst provided $C_{12}$+ oligomerate with the highest derived cetane. Cetane was derived using ASTM D6890 on the $C_{12}$+ fraction at the 204° C. (400° F.) cut point. Conversely to gasoline selectivity, the MTT catalyst A is superior in producing diesel range olefins, but the SPA catalyst B is the least effective in producing diesel range olefins.

The MTT catalyst was able to produce diesel with a cetane rating of greater than 40. The diesel cloud point was determined by ASTM D2500 to be −66° C. and the T90 was 319° C. using ASTM D86 Method. The T90 specification for diesel in the United States is between 282 and 338° C., so the diesel product meets the U.S. diesel standard.

Example 2

Figure 4:
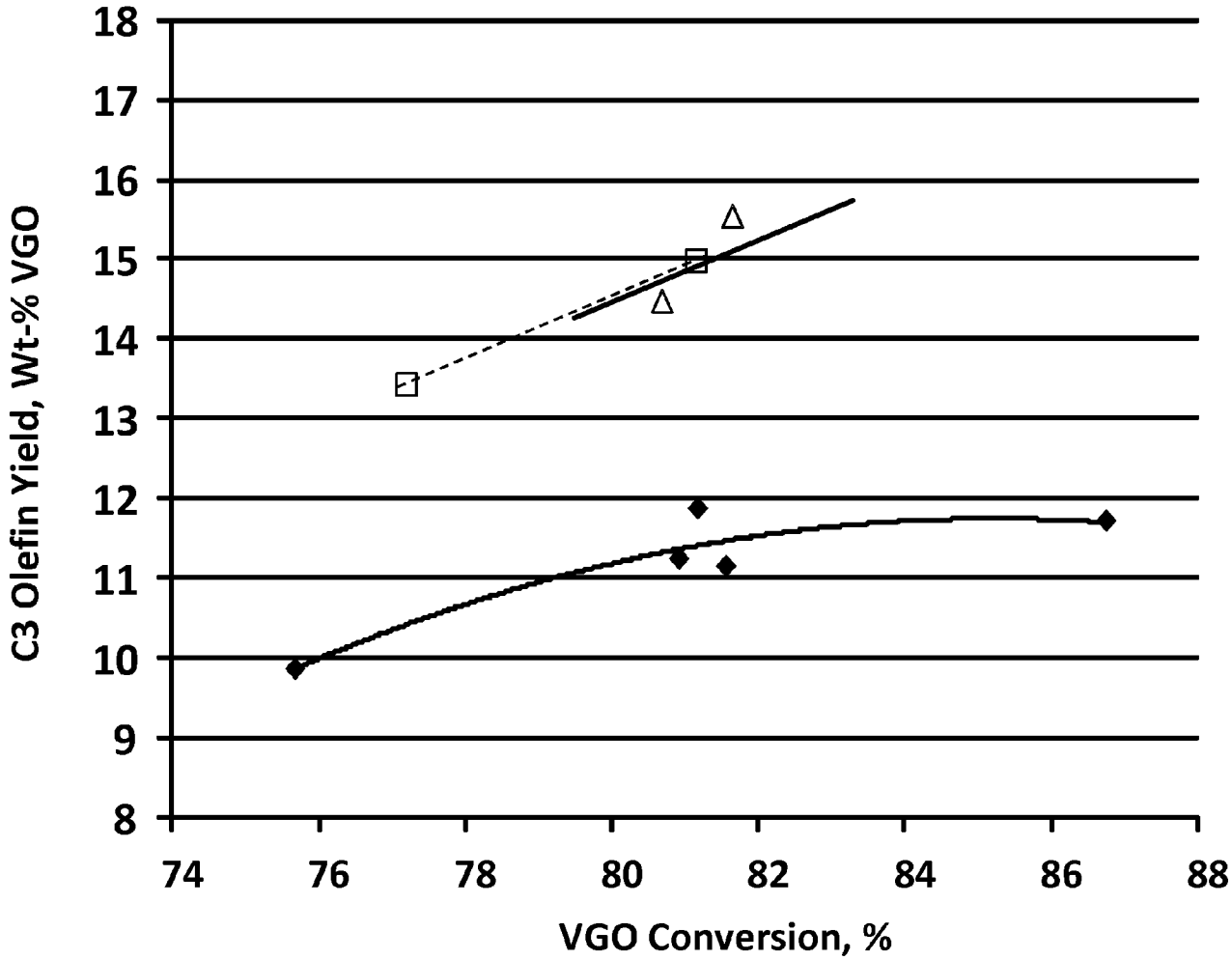
FIG. 4 is a plot of $C_3$ olefin yield versus VGO conversion.

Three feeds were reacted over FCC equilibrium catalyst comprising 8 wt % ZSM-5. Feed 2 comprised hydrotreated VGO with a hydrogen content of 13.0 wt %. Feed 3 comprised the same VGO mixed with 25 wt % oligomerate product catalyzed by Catalyst A of Example 1. Feed 4 comprised the same VGO mixed with 25 wt % oligomerate product catalyzed by Catalyst B of Example 1. The feeds were heated to 260° to 287° C. and contacted with the FCC catalyst in a riser apparatus to achieve 2.5 to 3.0 seconds of residence time. FIG. 4 plots $C_3$ olefin yield versus VGO conversion. The key for FIG. 4 is in Table 4.

TABLE 4

| Feed | Composition | Key |
|---|---|---|
| Feed 2 | VGO | Solid diamond |
| Feed 3 | VGO/MTT oligomerate | Square |
| Feed 4 | VGO/SPA oligomerate | Triangle |

FIG. 4 shows that recycle of oligomerate product to the FCC zone can boost propylene production. At the apex of the propylene yield curve of VGO alone, the feed comprising VGO and oligomerate provided 3.2 wt % more propylene yield from the FCC zone.

Example 3

Feed 1 of Example 1 was contacted with an amorphous silica-alumina catalyst with a silicon-to-aluminum ratio of 3 prepared by the oil-drop method as previously described. The finished catalyst had a density of 0.57 g/ml, a total acidity of 0.203 millimoles/g, a low temperature peak of 0.065 millimoles/g and a low temperature acidity ratio of 0.32.

Figure 5:
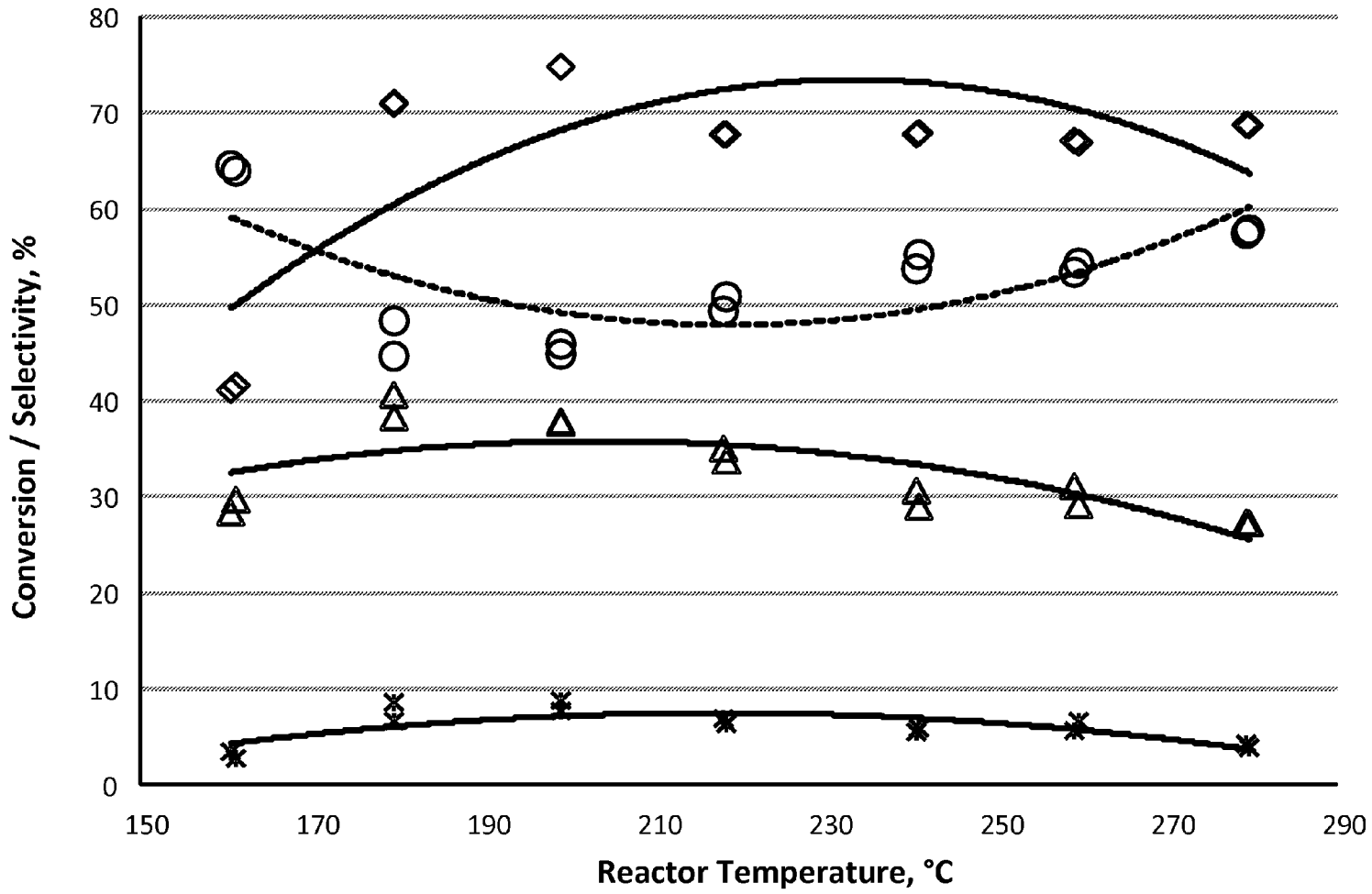
FIG. 5 is a plot of conversion and selectivity versus reactor temperature.

The experiments were operated at 6.2 MPa, 0.75 WHSV and inlet temperatures at intervals between 160 and 270° C. to obtain different normal butene conversions. Results are shown in FIG. 5. The key for FIG. 5 is shown in Table 5.

TABLE 5

| Identity | marker |
|---|---|
| n-$C_4$ conversion | diamonds |
| $C_8$-$C_{11}$ selectivity | circles |
| $C_{12}$-$C_{15}$ selectivity | triangles |
| $C_{16}$+ selectivity | asterisks |

The results show that the amorphous silica alumina catalyst was effective in oligomerizing butenes, readily giving conversion levels above 70% and produced a product high in naphthenes suitable for conversion to aromatics. The product was distilled into multiple fractions; the fraction boiling between 80° and 150° C., the $C_6$-$C_8$ range, had a specific gravity of 0.73 g/ml. Table 6 shows specific gravity measurements for specific compounds boiling between 80° and 150° C. and the fraction made in this experiment. The specific gravity for the oligomerate is higher than for acyclic hydrocarbons in the $C_6$-$C_8$ range indicating the substantial presence of naphthenes.

TABLE 6

| Compound | Density (g/mL) |
|---|---|
| n-hexane | 0.65 |
| 1-heptene | 0.70 |
| n-octane | 0.70 |
| 4-methylheptane | 0.71 |
| 2,4,4-trimethyl-1-pentene | 0.71 |
| 2-methyl-1-heptene | 0.71 |
| 80° C.-150° C. fraction | 0.73 |
| methylcyclohexane | 0.77 |
| 1,4-dimethylcyclohexane | 0.77 |
| Toluene | 0.87 |

Example 4

Feed 5 with properties indicated in Table 7 was contacted with an amorphous silica-alumina catalyst. The extruded amorphous silica-alumina catalyst comprised 85 wt % silica-alumina having a silica-to-alumina ratio of 2.6 purchased from CCIC and 15 wt % alumina. The finished catalyst had a silica-to-alumina ratio of 1.92, a surface area of 368 $m^2/g$, a density of 0.49 g/ml, a total acidity of 0.285 millimoles/g, a low temperature peak of 0.092 millimoles/g and a low temperature acidity ratio of 0.32.

TABLE 7

| Compound | Wt % |
|---|---|
| Propane | 23.4 |
| Propylene | 25.6 |
| Isobutene | 16.5 |
| Isobutane | 34.5 |

The experiments were operated at 3.5 MPa, 2.5 WHSV and inlet temperatures at 150 and 170° C. to obtain different butene conversions. Results are shown in Table 8. The results show that the amorphous silica alumina catalyst was effective in oligomerizing butenes, readily giving conversion levels above 50% and produced a product with a substantial fraction of naphthenes such as methylcyclohexane and cyclohexane suitable for conversion to aromatics, particularly at higher conversion indicated by the higher temperature.

TABLE 8

| Temperature, ° C. | 150 | 170 |
|---|---|---|
| Total Conversion, wt % | 47 | 70 |
| $C_3$ Olefin Conversion, wt % | 40 | 72 |
| $C_4$ Olefin Conversion, wt % | 55 | 68 |
| $C_7$ Selectivity, wt % | 26 | 24 |
| Methylcyclohexane/total $C_7$ | 1.3 | 5 |
| 2,3-dimethylcyclopentane/total $C_7$ | 77 | 70 |
| 2,2-dimethylcyclopentane/total $C_7$ | 9 | 5 |
| 2-methylcyclohexane/total $C_7$ | 8.5 | 13.5 |
| $C_6$ Selectivity, wt % | 9 | 16 |
| Methylcyclopentane/total $C_6$ | 28 | 33 |
| Cyclohexane/total $C_6$ | 6 | 10 |

Specific Embodiments

While the following is described in conjunction with specific embodiments, it will be understood that this description is intended to illustrate and not limit the scope of the preceding description and the appended claims.

A first embodiment of the invention is a process for oligomerizing light olefins comprising contacting an oligomerization feed of $C_4$ olefins with a first oligomerization catalyst and a second oligomerization catalyst, the second oligomerization catalyst comprising amorphous silica alumina and is different from the first oligomerization catalyst, and recovering an oligomerate stream. An embodiment of the invention is one, any or all of prior embodiments in this paragraph up through the first embodiment in this paragraph further comprising feeding a first oligomerization feed to a first oligomerization reactor zone containing the first oligomerization catalyst and bypassing the first oligomerization feed around a second oligomerization reactor zone containing the second oligomerization catalyst. An embodiment of the invention is one, any or all of prior embodiments in this paragraph up through the first embodiment in this paragraph wherein the first oligomerization catalyst comprises a solid phosphoric acid catalyst. An embodiment of the invention is one, any or all of prior embodiments in this paragraph up through the first embodiment in this paragraph wherein the first oligomerization catalyst comprises a zeolitic catalyst. An embodiment of the invention is one, any or all of prior embodiments in this paragraph up through the first embodiment in this paragraph wherein the first oligomerization catalyst comprises an MTT zeolite. An embodiment of the invention is one, any or all of prior embodiments in this paragraph up through the first embodiment in this paragraph further comprising stopping the flow of at least a portion of the first oligomerization feed to the first oligomerization reactor zone and diverting the flow of the portion of the first oligomerization feed to the second oligomerization reactor zone while bypassing the portion of the first oligomerization feed around the first oligomerization reactor zone. An embodiment of the invention is one, any or all of prior embodiments in this paragraph up through the first embodiment in this paragraph further comprising separating a product stream from a first oligomerate stream from the first oligomerization reactor and a second oligomerate stream from the second oligomerization reactor together. An embodiment of the invention is one, any or all of prior embodiments in this paragraph up through the first embodiment in this paragraph wherein the oligomerate produced by contact of the oligomerization feed with the second oligomerization catalyst comprises a greater concentration of naphthenes than by contact of the oligomerization feed with the first oligomerization catalyst. An embodiment of the invention is one, any or all of prior embodiments in this paragraph up through the first embodiment in this paragraph further comprising feeding a second oligomerization feed of $C_4$ olefins to the second oligomerization reactor zone and bypassing the second oligomerization feed around the first oligomerization reactor zone.

A second embodiment of the invention is a process for oligomerizing light olefins comprising providing an oligomerization feed of $C_4$ olefins to an oligomerization zone; feeding a first oligomerization feed of $C_4$ olefins to a first oligomerization reactor zone containing a first oligomerization catalyst and bypassing the first oligomerization feed around a second oligomerization reactor zone containing a second oligomerization catalyst that is different from the first oligomerization catalyst; feeding a second oligomerization feed of $C_4$ olefins to the second oligomerization reactor zone containing the second oligomerization catalyst comprising amorphous silica alumina and bypassing the second oligomerization feed around the first oligomerization reactor zone; and recovering an oligomerate stream. An embodiment of the invention is one, any or all of prior embodiments in this paragraph up through the second embodiment in this paragraph wherein the first oligomerization catalyst comprises a solid phosphoric acid catalyst. An embodiment of the invention is one, any or all of prior embodiments in this paragraph up through the second embodiment in this paragraph wherein the first oligomerization catalyst comprises a zeolite. An embodiment of the invention is one, any or all of prior embodiments in this paragraph up through the second embodiment in this paragraph further comprising stopping the flow of at least a portion of the first oligomerization feed to the first oligomerization reactor zone and diverting the flow of the portion of the first oligomerization feed to the second oligomerization reactor zone while bypassing the portion of the first oligomerization feed around the first oligomerization reactor zone. An embodiment of the invention is one, any or all of prior embodiments in this paragraph up through the second embodiment in this paragraph wherein an oligomerate produced in the second oligomerization reactor zone comprises a greater concentration of naphthenes than an oligomerate produced in the first oligomerization reactor zone. An embodiment of the invention is one, any or all of prior embodiments in this paragraph up through the second embodiment in this paragraph further comprising separating a product stream from the oligomerate stream and cracking at least a portion of the product stream in an FCC unit.

A third embodiment of the invention is a process for oligomerizing light olefins comprising providing an oligomerization feed of $C_4$ olefins to an oligomerization zone; feeding a first oligomerization feed of $C_4$ olefins to a first oligomerization reactor zone containing a first oligomerization catalyst comprising SPA or a zeolite and bypassing the first oligomerization feed around a second oligomerization reactor zone; feeding a second oligomerization feed of $C_4$ olefins to the second oligomerization reactor zone containing a second oligomerization catalyst comprising amorphous silica alumina and bypassing the second oligomerization feed around the first oligomerization reactor zone; and recovering an oligomerate stream. An embodiment of the invention is one, any or all of prior embodiments in this paragraph up through the third embodiment in this paragraph further comprising stopping the flow of at least a portion of the first oligomerization feed to the first oligomerization reactor zone and diverting the flow of the portion of the first oligomerization feed to the second oligomerization reactor zone while bypassing the portion of the first oligomerization feed around the first oligomerization reactor zone. An embodiment of the invention is one, any or all of prior embodiments in this paragraph up through the third embodiment in this paragraph further comprising stopping the flow of at least a portion of the second oligomerization feed to the second oligomerization reactor zone and diverting the flow of the portion of the second oligomerization feed to the first oligomerization reactor zone while bypassing the portion of the second oligomerization feed around the second oligomerization reactor zone. An embodiment of the invention is one, any or all of prior embodiments in this paragraph up through the third embodiment in this paragraph further comprising separating from a product stream a first oligomerate stream from the first oligomerization reactor and a second oligomerate stream from the second oligomerization reactor together. An embodiment of the invention is one, any or all of prior embodiments in this paragraph up through the third embodiment in this paragraph further comprising separating a product stream from the oligomerate stream and cracking at least a portion of the product stream in an FCC unit.

Preferred embodiments of this invention are described herein, including the best mode known to the inventors for carrying out the invention. It should be understood that the illustrated embodiments are exemplary only, and should not be taken as limiting the scope of the invention.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated. Pressures are given at the vessel outlet and particularly at the vapor outlet in vessels with multiple outlets. Control valves should be opened or closed as consistent with the intent of the disclosure.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for oligomerizing light olefins comprising:

providing a first oligomerization reactor zone containing a first oligomerization catalyst selected from a zeolitic catalyst or a solid phosphoric acid catalyst;

providing a second oligomerization reactor zone containing an amorphous silica alumina catalyst;

providing an oligomerization feed stream comprising $C_4$ olefins;

providing a first conduit control valve to control flow of a first oligomerization feed;

providing a second conduit control valve to control flow of a second oligomerization feed;

controlling said conduit control valves to split said oligomerization feed stream into said first oligomerization feed and said second oligomerization feed in aliquot portions of equivalent compositions;

feeding said first oligomerization feed to said first oligomerization reactor zone to yield a first product comprising aliphatic olefins;

feeding said second oligomerization feed to said second oligomerization reactor zone to yield a second product comprising naphthenes;

oligomerizing said first wherein the concentration of naphthenes in the second product is greater than in the first product;

varying the aliquot portions of said feed streams to achieve desired quantity of aliphatic olefins or naphthenes desired;

recovering the first and second products.

2. The process of claim 1 wherein said zeolitic catalyst comprises an MTT zeolite.

3. The process of claim 1 wherein said first oligomerization zone contains the zeolitic catalyst and said zeolitic catalyst comprises an MTT zeolite.

4. The process of claim 1 wherein said amorphous silica alumina catalyst is characterized by a weight ratio of silica-to-alumina in the range of between 0.5:1 and about 9:1.

5. The process of claim 4 wherein said amorphous silica alumina catalyst is characterized by a Low Temperature Acidity Ratio of at least about 0.15.

6. The process of claim 1 wherein said oligomerization feed stream further comprises $C_5$ olefins.

7. The process of claim 1 further comprising stopping a portion of the first oligomerization feed to said first oligomerization reactor zone and diverting the portion of the first oligomerization feed to said second oligomerization reactor zone while bypassing the portion of the first oligomerization feed around the first oligomerization reactor zone.

8. The process of claim 1 further comprising stopping a portion of said second oligomerization feed to said second oligomerization reactor zone; and diverting the portion of said second oligomerization feed to said first oligomerization reactor zone while bypassing the portion of the second oligomerization feed around the second oligomerization reactor zone.

9. The process of claim 1 further comprising incorporating into said oligomerization feed stream an intermediate recycle stream comprising at least 70 wt % $C_5$ hydrocarbons.

10. The process of claim 9 wherein the mass flow rate of the intermediate recycle stream is at least as great as and suitably no greater than three times the mass flow rate of said first oligomerization feed.

11. The process of claim 1 further comprising recovering a first overhead light stream comprising $C_4$ olefins and hydrocarbons and a first liquid oligomerate bottom stream comprising $C_{5+}$ olefins and hydrocarbons;

separating said first liquid oligomerate bottom steam into an intermediate stream comprising $C_5$ olefins and hydrocarbons and a second liquid oligomerate bottom product stream comprising $C_{6+}$ olefins;

separating said second liquid oligomerate bottom product stream in a distillate separator column into a gasoline overhead stream and a distillate bottom stream; and recovering a gasoline product from said gasoline overhead stream and a distillate product from said distillate bottom stream.

12. A process for oligomerizing light olefins comprising:

providing a first oligomerization reactor zone containing a first oligomerization catalyst selected from a zeolitic catalyst or a solid phosphoric acid catalyst;

providing a second oligomerization reactor zone containing an amorphous silica alumina catalyst;

providing an oligomerization feed stream comprising $C_4$ olefins;

incorporating an intermediate recycle stream comprising at least 70 wt % $C_5$ hydrocarbons into said oligomerization feed stream;

providing a first conduit control valve to control flow of a first oligomerization feed;

providing a second conduit control valve to control flow of a second oligomerization feed;

controlling said conduit control valves to split said oligomerization feed stream into said first oligomerization feed and said second oligomerization feed in aliquot portions of equivalent compositions;

feeding said first mixed oligomerization feed to said first oligomerization reactor zone to yield a first product comprising aliphatic olefins;

feeding said second mixed oligomerization feed to said second oligomerization reactor zone to yield a second product comprising naphthenes;

oligomerizing said first wherein the concentration of naphthenes in the second product is greater than in the first product;

varying said aliquot portions of said oligomerization feed streams to achieve desired quantity of aliphatic olefins or naphthenes desired;

recovering a first overhead light stream comprising $C_4$ olefins and hydrocarbons and a first liquid oligomerate bottom stream comprising $C_{5+}$ olefins and hydrocarbons;

separating said first liquid oligomerate bottom steam into an intermediate stream comprising $C_5$ olefins and hydrocarbons and a second liquid oligomerate bottom product stream comprising $C_{6+}$ olefins;

splitting said intermediate stream into said intermediate recycle stream and a purge stream;

splitting said second liquid oligomerate bottom product stream into a FCC recycle stream and an oligomerate product stream;

recovering a gasoline product from said oligomerate product stream; and feeding said FCC recycle stream to a FCC zone to convert naphthenes to aromatics.

13. The process of 12 wherein said oligomerization feed stream further comprises $C_5$ olefins.

14. The process of claim 12 wherein said first oligomerization zone contains the zeolitic catalyst and said zeolitic catalyst comprises an MTT zeolite.

15. The process of claim 12 wherein said amorphous silica alumina catalyst is characterized by a weight ratio of silica-to-alumina in the range of between 0.5:1 and about 9:1.

16. The process of claim 12 wherein said amorphous silica alumina catalyst is characterized by a low temperature acidity ratio of at least about 0.15.

17. A process for producing propylene and aromatics by oligomerizing light olefins comprising:

cracking a hydrocarbon feed over an FCC catalyst in an FCC zone to produce spent FCC catalyst and a cracked product stream;

obtaining an oligomerization feed stream comprising $C_4$ and $C_5$ olefins from said cracked product stream;

providing a first oligomerization reactor zone containing a first oligomerization catalyst selected from a zeolitic catalyst or a solid phosphoric acid catalyst;

providing a second oligomerization reactor zone containing an amorphous silica alumina catalyst;

incorporating an intermediate recycle stream comprising at least 70 wt % $C_5$ hydrocarbons into said oligomerization feed stream;

providing a first conduit control valve to control flow of a first oligomerization feed;

providing a second conduit control valve to control flow of a second oligomerization feed;

controlling said conduit control valves to split said oligomerization feed stream into said first oligomerization feed and said second oligomerization feed in aliquot portions of equivalent compositions;

feeding said first oligomerization feed to said first oligomerization reactor zone to yield a first product comprising aliphatic olefins;

feeding said second oligomerization feed to said second oligomerization reactor zone to yield a second product comprising naphthenes;

oligomerizing said first wherein the concentration of naphthenes in the second product is greater than in the first product;

varying said aliquot portions of said oligomerization feed streams to achieve desired quantity of aliphatic olefins or naphthenes desired;

recovering a first overhead light stream comprising $C_4$ olefins and hydrocarbons and a first liquid oligomerate bottom stream comprising $C_{5+}$ olefins and hydrocarbons;

separating said first liquid oligomerate bottom steam into an intermediate stream comprising $C_5$ olefins and hydrocarbons and a second liquid oligomerate bottom product stream comprising $C_{6+}$ olefins;

splitting said intermediate stream into said intermediate recycle stream and a purge stream;

splitting said second liquid oligomerate bottom product stream into a FCC recycle stream and an oligomerate product stream;

recovering a gasoline product from said oligomerate product stream; and feeding said FCC recycle stream to said FCC zone as a portion of said hydrocarbon feed to convert naphthenes to aromatics and aliphatic olefins to propylene.

18. The process of claim 17 wherein said amorphous silica alumina catalyst is characterized by a weight ratio of silica-to-alumina in the range of between 0.5:1 and about 9:1.

* * * * *